US008389193B2

(12) United States Patent
Hara et al.

(10) Patent No.: US 8,389,193 B2
(45) **Date of Patent: *Mar. 5, 2013**

(54) METHOD OF MANUFACTURING TONER, TONER OBTAINED BY METHOD THEREOF, ONE-COMPONENT DEVELOPER, TWO-COMPONENT DEVELOPER, DEVELOPING DEVICE, AND IMAGE FORMING APPARATUS

(75) Inventors: Takashi Hara, Osaka (JP); Yoshitaka Kawase, Osaka (JP); Yoshiaki Akazawa, Osaka (JP); Yoritaka Tsubaki, Osaka (JP); Keiichi Kikawa, Osaka (JP); Yoshinori Mutoh, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 464 days.

This patent is subject to a terminal disclaimer.

(21) Appl. No.: 12/730,422

(22) Filed: Mar. 24, 2010

(65) Prior Publication Data

US 2010/0248114 A1 Sep. 30, 2010

(30) Foreign Application Priority Data

Mar. 26, 2009 (JP) ..... P2009-077763

(51) Int. Cl.
*G03G 5/00* (2006.01)

(52) U.S. Cl. ..... 430/137.11; 430/110.2; 399/252

(58) Field of Classification Search ..... 430/137.11, 430/110.2; 399/252
See application file for complete search history.

(56) References Cited

U.S. PATENT DOCUMENTS

| | | | | |
|---|---|---|---|---|
| 4,915,987 | A | 4/1990 | Nara et al. | |
| 5,296,266 | A | 3/1994 | Kunugi et al. | |
| 8,236,473 | B2 * | 8/2012 | Kawase et al. | 430/137.1 |
| 2005/0282078 | A1 | 12/2005 | Kataoka et al. | |
| 2008/0166156 | A1 | 7/2008 | Kawase | |

FOREIGN PATENT DOCUMENTS

| | | | |
|---|---|---|---|
| CN | 1710492 | A | 12/2005 |
| JP | 64-042660 | | 2/1989 |
| JP | 1-306859 | A | 12/1989 |
| JP | 03-293676 | | 12/1991 |
| JP | 04-182665 | | 6/1992 |
| JP | 04-182669 | | 6/1992 |

(Continued)

OTHER PUBLICATIONS

U.S. Appl. No. 12/731,396, filed Mar. 25, 2010, entitled "Method of Manufacturing Toner, Toner Obtained by Method Thereof, One-Component Developer, Two-Component Developer, Developing Device and Image Forming Apparatus".
Notice of Allowance mailed Apr. 19, 2012 in U.S. Appl. No. 12/605,686.

(Continued)

*Primary Examiner* — Mark A Chapman
(74) *Attorney, Agent, or Firm* — Nixon & Vanderhye PC

(57) ABSTRACT

There are provided a toner manufacturing method of manufacturing a toner which has excellent characteristics such as fluidity and preservation stability and in which a resin layer having uniform thickness is formed on a surface of tone core particle, a toner obtained by a method thereof, a one-component developer, a two-component developer, a developing device, and an image forming apparatus. By using a toner manufacturing apparatus, a stirring step S3 is performed, and during rotation of a rotary shaft section, after a completion of inputting the fine resin particles into a powder passage, and within a period satisfying $1.7 \leqq (\text{load } F - \text{load } F_0)/(\text{load } F_{core} - \text{load } F_0) \leqq 5.7$, a spraying step S4 is started.

10 Claims, 8 Drawing Sheets

FOREIGN PATENT DOCUMENTS

| | | | |
|---|---|---|---|
| JP | 04-211269 | | 8/1992 |
| JP | 5-10971 | | 2/1993 |
| JP | 07-261447 | | 10/1995 |
| JP | 2004-082005 | A | 3/2004 |
| JP | 2004-294468 | A | 10/2004 |
| JP | 2008-191639 | A | 8/2008 |
| JP | 2008-281625 | A | 11/2008 |

OTHER PUBLICATIONS

Restriction Requirement mailed Mar. 12, 2012 in U.S. Appl. No. 12/605,686.

Office Action mailed Aug. 30, 2012 in U.S. Appl. No. 12/731,396.

* cited by examiner

METHOD OF MANUFACTURING TONER, TONER OBTAINED BY METHOD THEREOF, ONE-COMPONENT DEVELOPER, TWO-COMPONENT DEVELOPER, DEVELOPING DEVICE, AND IMAGE FORMING APPARATUS

CROSS-REFERENCE TO RELATED APPLICATION

This application claims priority to Japanese Patent Application No. 2009-077763, which was filed on Mar. 26, 2009, the contents of which are incorporated herein by reference in its entirety.

BACKGROUND OF THE INVENTION

1. Field of the Invention

The present invention relates to a method of manufacturing a toner, a toner obtained by a method thereof, a one-component developer, a two-component developer, a developing device, and an image forming apparatus.

2. Description of the Related Art

An image forming apparatus employing an electrophotography forms an image by a charging step, an exposure step, a developing step, a transfer step, and a fixing step. At the charging step, the surface of a photoreceptor is uniformly charged by a charging section. At the exposure step, a laser beam is irradiated by the exposure section to the charged photoreceptor surface and an electrostatic latent image is formed. At the developing step, the electrostatic latent image on the photoreceptor is developed by a developing section and a toner image is formed on the photoreceptor. At the transfer step, the toner image on the photoreceptor is transferred onto a recording medium by a transfer section. At the fixing step, the toner image transferred onto the recording medium is heated by a fixing section and the toner image is fixed on the recording medium.

To realize energy saving of the image forming apparatus at the above fixing step, development of a low temperature fixation toner in which a binder resin whose softening point is low is used and which is fixable at a relatively low temperature, is in process. However, by using the binder resin whose softening point is low, preservation stability of a toner decreases and a toner aggregation may be generated.

Therefore, in order to enhance the preservation stability of the toner, a surface modification treatment for coating the surfaces of toner core particles with a coating material has been performed. By coating the toner core particles and manufacturing a toner, the toner aggregation is able to be suppressed.

Japanese Examined Patent Publication JP-B2 5-10971 (1993) discloses as a method of the surface modification treatment, a method that a mechanical stirring force is applied to powder particles by a rotary stirring section such as a screw, a blade, or a rotor to fluidize the powder particles in a powder flowing passage, a liquid is sprayed from a spray nozzle to the powder particles in a fluid state, and the surfaces of the powder particles are coated by a coating material contained in the spray liquid. According to the method described in JP-B2 5-10971, adhesiveness between the coating material and the powder particles is able to be improved and time required for the surface modification treatment is able to be shortened.

Further, Japanese Unexamined Patent Publication JP-A 4-211269 (1992) discloses a method of manufacturing a microcapsule in which resin particles are adhered to the surfaces of inner core particles and the resin particles are dissolved with a solvent to form a coating layer on the surface of the inner core particle. According to the method described in JP-A 4-211269, after forming the coating layer on the surface of the inner core particle with the treatment using the solvent, a microcapsule is obtained by drying and removing.

However, with the method disclosed in JP-B2 5-10971, the coating material in the spray liquid is in a state of aggregation, and the aggregation is adhered to the surfaces of the powder particles without disintegration. Thereby, there is a problem that the film thickness of a coating material film to be formed on the surface of the powder particle is non-uniform.

Additionally, the state of aggregation of the coating material varies depending on the steps of manufacturing the coating material. The size of the disintegrated coating material varies depending on the size of the coating material in the state of aggregation. Then, depending on the size of the disintegrated coating material, a stirring period required for sufficiently adhering the coating material to the surfaces of the power particles varies. Therefore, in the method described in JP-B2 5-10971, even though the coating material is disintegrated before being adhered to the surfaces of the power particles, when the stirring period is too short, the coating material does not adhere to the surfaces of the powder particles sufficiently and the film thickness of the coating material film is still non-uniform.

On the other hand, when the stirring period is too long, the powder particles are melted with the heat generated by the stirring. There is a problem that when the powder particles contain wax or the like, by the melting of the powder particles, a release agent or the like exudes into the coating material film, and the characteristics of toner such as the fluidity and the preservation stability are degradated.

Further according to the method described in JP-A 4-211269, the solvent becomes hard to vaporize by dissolving the resin particles. Thereby, the aggregate of the inner core particles are generated or the inner core particles adhere to an inner wall surface of the manufacturing apparatus. As a result, the yield of the microcapsule is lowered. Moreover, some type of solvent may even dissolve the inner core particles. When the inner core particles are dissolved, an additive such as a release agent existed inside the inner core particles is fixed or exposed on the surfaces of the inner core particles, and the preservation stability or the like of the microcapsule is lowered.

SUMMARY OF THE INVENTION

The invention is to solve the problems described above, and an object of the invention is to provide a toner manufacturing method of manufacturing a toner which has excellent characteristics such as fluidity and preservation stability and in which a resin layer having a uniform thickness is formed on a surface of a toner core particle, a toner obtained by the method, a one-component developer, a two-component developer, a developing device and an image forming apparatus.

The invention provides a toner manufacturing method of manufacturing a toner using a toner manufacturing apparatus comprising a powder passage in which powder is flowable, a carrier gas supplying section that supplies a carrier gas to the powder passage, a spraying section that sprays a predetermined substance with the carrier gas to the powder passage, a rotary stirring section disposed in the powder passage for stirring particles in the powder passage to fluidize the particles in the powder passage, and an discharging section that discharges a gas from the powder passage, comprising:

a stirring step of rotating the rotary stirring section at a predetermined rotation speed and fluidizing toner core particles and fine resin particles in the power passage as the powder; and a spraying step of spraying with the carrier gas a liquid that plasticizes the fine resin particles as the predetermined substance by the spraying section, during rotation of the rotary stirring section, after a completion of inputting the fine resin particles into the powder passage, and within a period satisfying the following formula (1), the spraying step is started:

$$1.7 \leqq (F-F_0)/(F_{core}-F_0) \leqq 5.7 \quad (1)$$

where $F_0$ is a load applied to the rotary stirring section when the rotary stirring section is rotated at idle at the predetermined rotation speed, $F_{core}$ is a load applied to the rotary stirring section when the rotary stirring section is rotated at the predetermined rotation speed, and only the toner core particles are fluidized in the powder passage as the powder, and F is a load applied to the rotary stirring section in the stirring step.

According to the invention, when $(F-F_0)/(F_{core}-F_0)$ (hereinafter, $(F-F_0)/(F_{core}\ F_0)$ is defined as f and referred to as "load coefficient f") is 5.7 or less, the spraying step is started. That is, irrespective of the size of secondary aggregate of the fine resin particles inputted to the toner manufacturing apparatus, after the fine resin particles disintegrated from the state of the secondary aggregate is sufficiently adhered to the surfaces of the toner core particles, spraying of the liquid that plasticizes the fine resin particles is started. Thereby, a toner in which a resin layer whose thickness is uniform is formed on the surface of the toner core particle is able to be manufactured.

Further, when the load coefficient f is 1.7 or more, the spraying step is started. That is, before melting of the toner core particles and the fine resin particles are proceeded by excessive heating, spraying of the liquid that plasticizes the fine resin particles is started. Thereby, exuding of an additive such as a release agent contained in the toner core particles into the surfaces of the toner core particles is able to be prevented. Accordingly, a toner whose characteristics such as fluidity and preservation stability are excellent is able to be manufactured.

Further, in the invention, it is preferable that during rotation of the rotary stirring section, after a completion of inputting the fine resin particles into the powder passage, and within a period satisfying the following formula (2), the spraying step is started:

$$2.15 \leqq (F-F_0)/(F_{core}-F_0) \leqq 4.15 \quad (2).$$

According to the invention, when the load coefficient f is 4.15 or less, the spraying step is started. That is, irrespective of the size of secondary aggregate of the fine resin particles inputted to the toner manufacturing apparatus, after the fine resin particles disintegrated from the state of the secondary aggregate is sufficiently adhered to the surfaces of the toner core particles, spraying of the liquid that plasticizes the fine resin particles is started. Thereby, a toner in which a resin layer whose thickness is more uniform is formed on the surface of the toner core particle is able to be manufactured.

Further, when the load coefficient f is 2.15 or more, the spraying step is started. That is, before the toner core particles and the fine resin particles are excessively heated and melted, spraying of the liquid that plasticizes the fine resin particles is started. Thereby, exuding of an additive such as a release agent contained in the toner core particles to the surfaces of the toner core particles is able to be prevented. Accordingly, a toner whose characteristics such as fluidity and preservation stability are excellent is able to be manufactured.

Further, in the invention, it is preferable that the rotary stirring section is an element that includes a driving motor and rotates and stirs by applying current to the driving motor, and the load applied to the rotary stirring section is obtained by measuring a current value of the current applied to the rotary stirring section.

According to the invention, the load applied to the rotary stirring section is able to be measured easily and accurately.

Further, the invention provides a toner obtained by the toner manufacturing method mentioned above.

According to the invention, the toner according to the invention is a toner that a resin layer whose thickness is uniform and exuding of an additive is suppressed. Accordingly, it is possible to form an image with high definition and high image quality without unevenness in the concentration for a long time.

Further, the invention provides a one-component developer comprising the toner mentioned above.

According to the invention, by containing the toner, a one-component developer capable of forming an image with high definition and high image quality without unevenness in the concentration for a long time is able to be realized.

Further, the invention provides a two-component developer comprising the toner mentioned above and a carrier.

According to the invention, by containing the toner and a carrier, it is possible to realize a two-component developer capable of stably forming an image that has high definition and high image quality without unevenness in the concentration for a long time.

Further, the invention provides a developing device that performs development by using the one-component developer or two-component developer mentioned above.

According to the invention, by performing a development using the one-component developer or two-component developer mentioned above, it is possible to realize a developing device capable of stably forming an image that has high definition and high image quality without unevenness in the concentration for a long time.

Further, the invention provides an image forming apparatus comprising the developing device mentioned above.

According to the invention, by including the developing device, it is possible to realize an image forming apparatus capable of stably forming an image that has high definition and high image quality without unevenness in the concentration for a long time.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
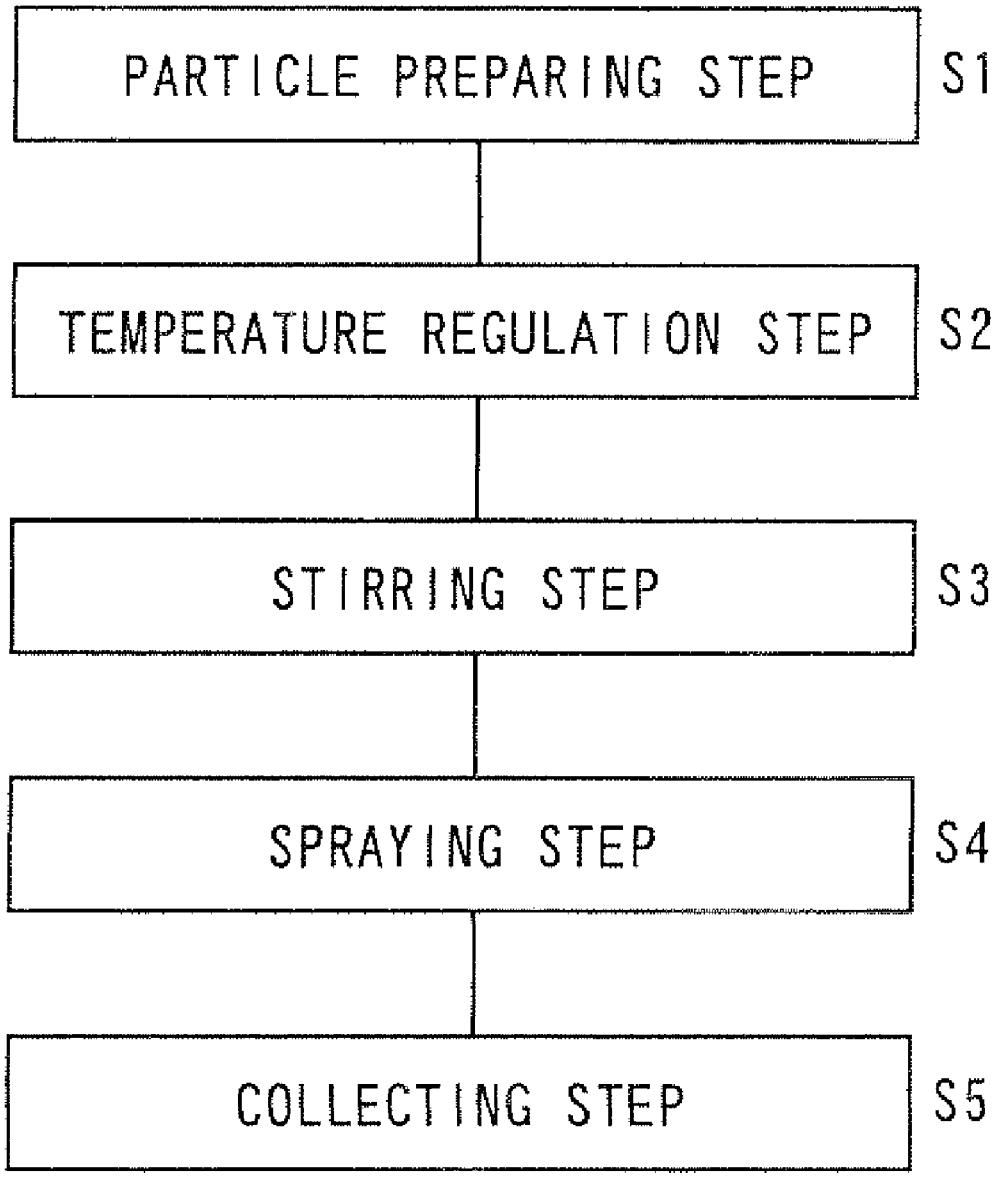
FIG. 1 is a process drawing showing a toner manufacturing process.

Now referring to the drawings, preferred embodiments of the invention are described below.

1. Toner Manufacturing Method

A toner manufacturing method according to the invention is a manufacturing method that is performed by using a specific toner manufacturing apparatus and includes a stirring step at which toner core particles and fine resin particles are fluidized in a powder passage by rotating a rotary stirring section at a predetermined rotation speed, and a spraying step at which the liquid that plasticizes fine resin particles is sprayed with carrier gas by a spraying section. The specific toner manufacturing apparatus is a toner manufacturing apparatus comprising a powder passage in which powder is flowable, a carrier gas supplying section that supplies carrier gas into the powder passage, a spraying section that sprays a predetermined substance with carrier gas into the powder passage, a rotary stirring section provided in the powder passage and stirs particles in the powder passage to fluidize the particles in the powder passage, and a discharging section that discharges a gas from the powder passage.

Description for a toner manufacturing step as an embodiment of a method of manufacturing a toner according to the invention will be given below. FIG. 1 is a process drawing showing a toner manufacturing process. The toner manufacturing process includes a particle preparing step S1, a temperature regulation step S2, a stirring step S3, a spraying step S4, and a collecting step S5.

At the particle preparing step S1, toner core particles and fine resin particles are respectively prepared. At the temperature regulation step S2, temperature in a toner manufacturing apparatus 201 shown in FIG. 2 and described below is regulated. At the stirring step S3, toner core particles and fine resin particles are fluidized in the toner manufacturing apparatus 201 and fine resin particles are adhered to the surfaces of toner core particles. At the spraying step S4, a liquid that plasticizes fine resin particles (hereinafter, referred to as "spray liquid") is sprayed into the toner manufacturing apparatus 201, whereby fine resin particles adhered to toner core particles are plasticized to form a resin layer on the surface of the toner core particle. At the collecting step S5, toner core particles (toner particles) that a resin layer is formed on the surface thereof are collected. Description will be given in detail below for each of the steps S1 to S5.

(1) Particle Preparing Step S1

At the particle preparing step S1, toner core particles and fine resin particles are respectively prepared.

(i) Preparation of Toner Core Particles

The toner core particles are particles each containing a binder resin and a colorant and can be obtained with a known preparation method. A preparation method thereof is not particularly limited. Examples of the method for preparing toner core particles include dry methods such as pulverization methods, and wet methods such as suspension polymerization methods, emulsion aggregation methods, dispersion polymerization methods, dissolution suspension methods and melting emulsion methods. The preparation of toner core particles using a pulverization method will be described below.

(Raw Materials of Toner Core Particles)

The binder resin is hot particularly limited and any known binder resin used for a black toner or a color toner is usable. Examples thereof include styrene resin such as polystyrene and styrene-acrylic acid ester copolymer resin, acrylic resin such as polymethylmethacrylate, polyolefin resin such as polyethylene, polyester, polyurethane, and epoxy resin. Further, resin obtained by polymerization reaction induced by mixing a monomer mixture material and a release agent may be used. The binder resins may be used each alone, or two or more of them may be used in combination.

It is preferred that the binder resin have a glass transition point of 30° C. or higher and 80° C. or lower. The binder resin having a glass transition point lower than 30° C. easily causes the blocking that the toner thermally aggregates inside the image forming apparatus, which decreases preservation stability of the toner. The binder resin having a glass transition point exceeding 80° C. lowers the fixing property of the toner onto a recording medium, which causes a fixing failure.

Among the above-described binder resins, polyester is excellent in transparency and capable of providing the aggregated particles with suitable powder flowability, low-temperature fixing properties, and secondary color reproducibility, thus being appropriate as a binder resin for a color toner. As polyester, heretofore known ingredients can be used, including a polycondensation of polybasic acid and polyhydric alcohol. As polybasic acid, those known as monomers for polyester can be used, including aromatic carboxylic acids such as terephthalic acid, isophthalic acid, acid phthalic anhydride, trimellitic anhydride, pyromellitic acid, and naphthalene dicarboxylic acid; aliphatic carboxylic acids such as maleic acid anhydride, fumaric acid, succinic acid, alkenyl succinic anhydride, and adipic acid; and a methyl-esterified compound of these polybasic acids. The polybasic acids may be used each alone, or two or more of them may be used in combination.

For polyvalent alcohol, substances known as monomers for polyester can be used including, for example: aliphatic polyvalent alcohols such as ethylene glycol, propylene glycol, butenediol, hexanediol, neopentyl glycol, and glycerin; alicyclic polyvalent alcohols such as cyclohexanediol, cyclohexanedimethanol, and hydrogenated bisphenol A; and aromatic diols such as ethylene oxide adduct of bisphenol A and propylene oxide adduct of bisphenol A. The polyvalent alcohols may be used each alone, or two or more of them may be used in combination.

The polybasic acid and the polyvalent alcohol can undergo polycondensation reaction by a known method. Polycondensation reaction is undergone, for example, by making the polybasic acid and the polyvalent alcohol bring into contact with each other in the presence or absence of the organic solvent and in the presence of polycondensation catalyst. The polycondensation reaction ends when an acid number, a softening point, etc. of the polyester to be produced reach predetermined values. The polyester is obtained by such a polycondensation reaction.

Further, when the methyl-esterified compound of the polybasic acid is used as part of the polybasic acid, demethanol polycondensation reaction is caused. In the polycondensation reaction, a compounding ratio, a reaction rate, etc. of the polybasic acid and the polyvalent alcohol are appropriately modified, thereby being capable of, for example, adjusting a content of a carboxyl end group in the polyester and thus allowing for denaturation of the polyester. Further, when trimellitic anhydride is used as polybasic acid, a carboxyl group can simply introduce to a main chain of the polyester and thus the denatured polyester can be obtained. Note that polyester self-dispersible having self-dispersibility in water may also be polyester has at least one of a main chain and side chain bonded to a hydrophilic radical such as a carboxyl group or a sulfonate group. Further, polyester may be grafted with acrylic resin.

As the colorant, it is possible to use an organic dye, an organic pigment, an inorganic dye, an inorganic pigment or the like which is customarily used in the electrophotographic field.

Examples of black colorant include carbon black, copper oxide, manganese dioxide, aniline black, activated carbon, non-magnetic ferrite, magnetic ferrite, and magnetite.

Examples of yellow colorant include chrome yellow, zinc yellow, cadmium yellow, yellow iron oxide, mineral fast yellow, nickel titanium yellow, navel yellow, naphthol yellow S, hanza yellow G, hanza yellow 10 G, benzidine yellow G, benzidine yellow GR, quinoline yellow lake, permanent yellow NCG, tartrazine lake, C.I. pigment yellow 12, C.I. pigment yellow 13, C.I. pigment yellow 14, C.I. pigment yellow 15, C.I. pigment yellow 17, C.I. pigment yellow 93, C.I. pigment yellow 94, C.I. pigment yellow 138, C.I. pigment yellow 180, and C.I. pigment yellow 185.

Examples of orange colorant include red chrome yellow, molybdenum orange, permanent orange GTR, pyrazolone orange, vulcan orange, indanthrene brilliant orange RK, benzidine orange G, indanthrene brilliant orange GK, C.I. pigment orange 31, and C.I. pigment orange 43.

Examples of red colorant include red iron oxide, cadmium red, red lead, mercury sulfide, cadmium, permanent red 4R, lysol red, pyrazolone red, watching red, calcium salt, lake red C, lake red D, brilliant carmine 6B, eosin lake, rhodamine lake B, alizarin lake, brilliant carmine 3B, C.I. pigment red 2, C.I. pigment red 3, C.I. pigment red 5, C.I. pigment red 6, C.I. pigment red 7, C.I. pigment red 15, C.I. pigment red 16, C.I. pigment red 48:1, C.I. pigment red 53:1, C.I. pigment red 57:1, C.I. pigment red 122, C.I. pigment red 123, C.I. pigment red 139, C.I. pigment red 144, C.I. pigment red 149, C.I. pigment red 166, C.I. pigment red 177, C.I. pigment red 178, and C.I. pigment red 222.

Examples of purple colorant include manganese purple, fast violet B, and methyl violet lake.

Examples of blue colorant include Prussian blue, cobalt blue, alkali blue lake, Victoria blue lake, phthalocyanine blue, non-metal phthalocyanine blue, phthalocyanine blue-partial chlorination product, fast sky blue, indanthrene blue BC, C.I. pigment blue 15, C.I. pigment blue 15:2, C.I. pigment blue 15:3, C.I. pigment blue 16, and C.I. pigment blue 60.

Examples of green colorant include chromium green, chromium oxide, pigment green B, malachite green lake, final yellow green G, and C.I. pigment green 7.

Examples of white colorant include those compounds such as zinc oxide, titanium oxide, antimony white, and zinc sulfide.

The colorants may be used each alone, or two or more of the colorants of different colors may be used in combination. Further, two or more of the colorants with the same color may be used in combination. A usage of the colorant is not limited to a particular amount, and preferably 5 parts by weight to 20 parts by weight, and more preferably 5 parts by weight to 10 parts by weight based on 100 parts by weight of the binder resin.

Further, the toner core particles may contain a charge control agent as an additive. For the charge control agent, charge control agents commonly used in this field for controlling a positive charge or a negative charge are usable. Examples of the charge control agent for controlling a positive charge include a basic dye, a quaternary ammonium salt, a quaternary phosphonium salt, an aminopyrine, a pyrimidine compound, a polynuclear polyamino compound, an aminosilane, a nigrosine dye, a derivative thereof, a triphenylmethane derivative, a guanidine salt and an amidin salt.

Examples of the charge control agent for controlling a negative charge include an oil-soluble dye such as an oil black and a spirone black, a metal-containing azo compound, an azo complex dye, a naphthene acid metal salt, a metal complex or metal salt (the metal is a chrome, a zinc, a zirconium or the like) of a salicylic acid or of a derivative thereof, a boron compound, a fatty acid soap, a long-chain alkylcarboxylic acid salt and a resin acid soap. The charge control agents may be used each alone, or optionally two or more of them may be used in combination. Although the amount of the charge control agent to be used is not particularly limited and can be properly selected from a wide range, 0.5 part by weight and 3 parts by weight is preferably used based on 100 parts by weight of the binder resin.

Further, the toner core particles may contain a release agent as an additive. As the release agent, it is possible to use ingredients which are customarily used in the relevant field, including, for example, petroleum wax such as paraffin wax and derivatives thereof, and microcrystalline wax and derivatives thereof; hydrocarbon-based synthetic wax such as Fischer-Tropsch wax and derivatives thereof, polyolefin wax (e.g. polyethylene wax and polypropylene wax) and derivatives thereof, low-molecular-weight polypropylene wax and derivatives thereof, and polyolefinic polymer wax (low-molecular-weight polyethylene wax, etc.) and derivatives thereof; vegetable wax such as carnauba wax and derivatives thereof, rice wax and derivatives thereof, candelilla wax and derivatives thereof, and haze wax; animal wax such as bees wax and spermaceti wax; fat and oil-based synthetic wax such as fatty acid amides and phenolic fatty acid esters; long-chain carboxylic acids and derivatives thereof; long-chain alcohols and derivatives thereof; silicone polymers; and higher fatty acids. Note that examples of the derivatives include oxides, block copolymers of a vinylic monomer and wax, and graft-modified derivatives of a vinylic monomer and wax. A usage of the wax may be appropriately selected from a wide range without particularly limitation, and preferably 0.2 part by weight to 20 parts by weight, more preferably 0.5 part by weight to 10 parts by weight, and particularly preferably 1.0 part by weight to 8.0 parts by weight based on 100 parts by weight of the binder resin.

(Method for Preparing Toner Core Particles)

Preparation of Toner Core Particles by a pulverization method, toner core particles containing a binder resin, a colorant and other additives are dry-mixed by a mixer, and thereafter melt-kneaded by a kneading machine. The kneaded material obtained by melt-kneading is cooled and solidified, and then the solidified material is pulverized by a pulverizing machine. Subsequently, the toner core particles are optionally obtained by conducting adjustment of a particle size such as classification.

In dry-mixing, a masterbatch containing colorants, a composite particle containing additives may be used. The composite particle is capable of being manufactured, for example, by mixing two or more of the additives, an appropriate amount of water, and lower alcohol and granulating the mixture by a general granulating machine such as a high-speed mill, followed by drying. By using the masterbatch and the composite particle, colorants and additives are able to be uniformly dispersed into a kneaded product.

Usable mixers include heretofore known mixers including, for example, Henschel-type mixing devices such as HENSCHEL MIXER (trade name) manufactured by Mitsui Mining Co., Ltd., SUPERMIXER (trade name) manufactured by Kawata MFG Co., Ltd., and MECHANOMILL (trade name) manufactured by Okada Seiko Co., Ltd., ANGMILL (trade name) manufactured by Hosokawa Micron Corporation, HYBRIDIZATION SYSTEM (trade name) manufactured by Nara Machinery Co., Ltd., and COSMOSYSTEM (trade name) manufactured by Kawasaki Heavy Industries, Ltd.

Usable kneaders include heretofore known kneaders including, for example, commonly-used kneaders such as a twin-screw extruder, a three roll mill, and a laboplast mill. Specific examples of such kneaders include single or twin screw extruders such as TEM-100B (trade name) manufactured by Toshiba Machine Co., Ltd., PCM-65/87 (trade name) manufactured by Ikegai, Ltd., and PCM-30 (trade name) manufactured by Ikegai, Ltd., and open roll-type kneading machines such as KNEADEX (trade name) manufactured by Mitsui Mining Co., Ltd. Among them, the open roll-type kneading machines are preferable.

Usable pulverizing machines include heretofore known pulverizing machines including, for example, a jet pulverizing machine that performs pulverization using ultrasonic jet air stream, and an impact pulverizing machine that performs pulverization by guiding a solidified material to a space formed between a rotor that is rotated at high speed and a stator (liner).

For the classification, a known classifying machine removing excessively pulverized toner core particles by classification with a centrifugal force or classification with a wind force is usable and an example thereof includes a revolving type wind-fore classifying machine (rotary type wind-force classifying machine).

(Toner Core Particle)

The toner core particles preferably have a volume average particle size of 4 μm or more and 8 μm or less. In a case where the volume average particle size of the toner core particles is 4 μm or more and 8 μm or less, it is possible to stably form a high-definition image for a long time. In a case where the volume average particle size of the toner core particles is less than 4 μm, the particle size of the toner core particles becomes too small and high charging and low fluidity of the toner are likely to occur. When the high charging and the low fluidity of the toner occur, a toner is unable to be stably supplied to a photoreceptor and a background fog and image density decrease are likely to occur.

On the other hand, in a case where the volume average particle size of the toner core particles exceeds 8 μm, the particle size of the toner particles becomes too large and the layer thickness of a formed image is increased so that an image with remarkable granularity is likely to be generated. When the particle size of the toner particles becomes too large, the high-definition image is not obtainable. In addition, as the particle size of the toner core particles becomes too large, a specific surface area is reduced, resulting in decrease in a charge amount of the toner. When the charge amount of the toner is decreased, the toner is not stably supplied to the photoreceptor and pollution inside the apparatus due to toner scattering is likely to occur.

Moreover, in the case where the volume average particle size of the toner core particles is 4 μm or more and 8 μm or less, it is possible to reduce the particle size of the toner particles, whereby a high image density is obtained even with a small volume amount of toner adhesion, thus causing reducing a toner capacity for a developing device.

(ii) Preparation of Fine Resin Particles

Fine resin particles are used as a coating' material for coating the surfaces of toner core particles. In the present embodiment, fine resin particles are used as secondary aggregate obtained by a heretofore known drying method. The secondary aggregate is disintegrated at the stirring step S3, circulates in the toner manufacturing apparatus 201 as a fine particle whose size is close to a primary particle and adheres to the surface of the toner core particle.

By adhering the fine resin particles to the toner core particles and coating the toner core particles, it is possible to prevent aggregation of toners due to melting of a low-melting point release agent contained in the toner core particles, for example, during preservation of the toners. Additionally, since the shape of the fine resin particles remain on the surfaces of the toner core particles, it is possible to obtain toner particles excellent in cleaning performance comparing to toner particles having a smooth surface.

(Raw Materials of Fine Resin Particles)

For the resin used for raw materials of the fine resin particles, examples thereof include polyester, an acrylic resin, a styrene resin, and a styrene-acrylic copolymer. Among the above resins, the fine resin particles preferably contain at least one of an acrylic resin and a styrene-acrylic copolymer. The acrylic resin and the styrene-acrylic copolymer have many advantages such that the strength is high with light weight, transparency is high, the price is low, and fine resin particles having a uniform particle size are easily obtained.

Although the resin used for the fine resin particles may be the same kind of resin as the binder resin used for the toner core particles or may be a different kind of resin, the different kind of resin is preferably used in view of performing the surface modification of the toner.

When the different kind of resin is used as the resin used for the fine resin particles, a softening point of the resin used for the fine resin particles is preferably higher than a softening point of the binder resin used for the toner core particles. By using the resin having such a softening point, it is possible to prevent toners from being fused each other during preservation and to improve preservation stability. Further, the softening point of the resin used for the fine resin particles depends on an image forming apparatus in which the toner is used, but is preferably 80° C. or higher and 140° C. or lower. By using the resin having a softening point in such a temperature range, it is possible to obtain the toner having both the preservation stability and the fixing performance.

(Method for Preparing Fine Resin Particles)

The fine resin particles can be obtained, for example, emulsifying and dispersing raw materials of the fine resin particles into fine grains by using a homogenizer or the like machine. Further, the fine resin particles can also be obtained, for example, by polymerizing monomers.

The fine resin particles prepared are dried by a known drying method. A drying method is not particularly limited, and examples thereof include drying of a hot air receiving type, drying of heat transfer by heat conduction type, far infrared radiation drying, and microwave drying.

Depending on the drying method of the fine resin particles, the shape and the particle size distribution of the secondary aggregate of the fine resin particles vary. Furthermore, depending on the preservation condition or the preservation method, the shape and the particle size distribution of the secondary aggregate of the fine resin particles vary. Generally, when the preservation time becomes long, aggregation properties of the fine resin particles increase, and the disintegration becomes difficult. Therefore, so as not to increase the aggregation properties of the fine rein particles, at the time of drying, the temperature of the fine resin particles are preferably not caused to be excessively high. As a drying method that does not raise the temperature at the time of drying, a freeze-drying method is included.

(Fine Resin Particle)

A volume average particle size of the fine resin particles is required to be sufficiently smaller than the volume average particle size of the toner core particles.

The volume average particle size of the fine resin particles is preferably 0.05 μm or more and 1 μm or less, and more preferably 0.1 μm or more and 0.5 μm or less. In a case where the volume average particle size of the fine resin particles is 0.05 μm or more and 1 μm or less, a projection of a suitable size is formed on the surface of the toner core particle. With the projections, toner particles are easily caught by cleaning blades at the time of removing the toner, resulting in improvement of the cleaning performance.

Moreover, the volume average particle size of the secondary aggregate of the fine resin particles is preferably 1 μm or more and 50 μm or less. in a case where the volume average particle size of the secondary aggregate is within this range, handling of the secondary aggregate becomes easy and the handling ability is improved. Further, the efficiency of disintegrating the secondary aggregate is also improved.

(2) Toner Manufacturing Apparatus

Prior to the description for the temperature regulation step S2, description will be given for the toner manufacturing apparatus 201 used at the temperature regulation step S2, and the subsequent steps S3 to S5.

Figure 2:
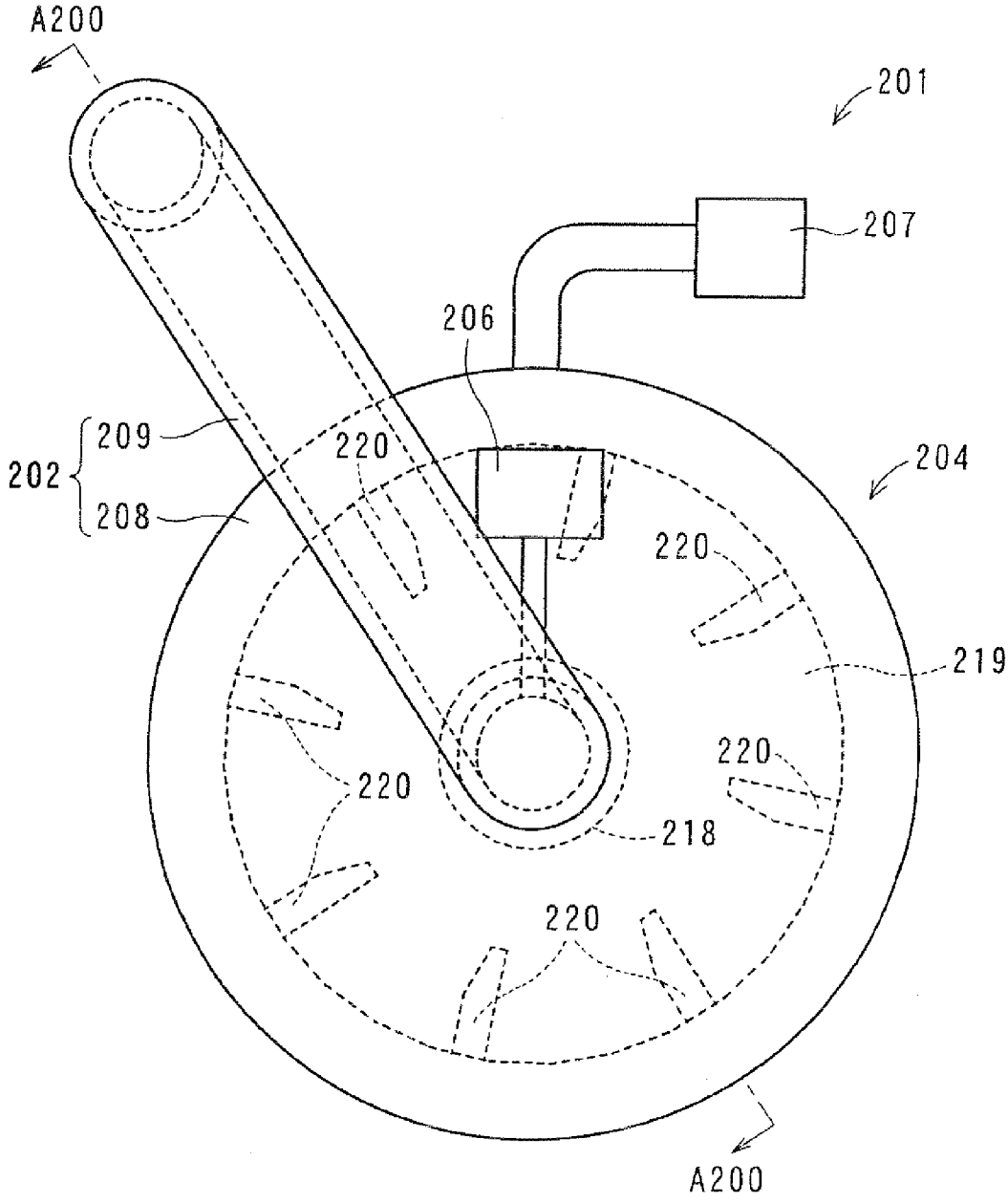
FIG. 2 is a front view of a toner manufacturing apparatus.
Figure 3:
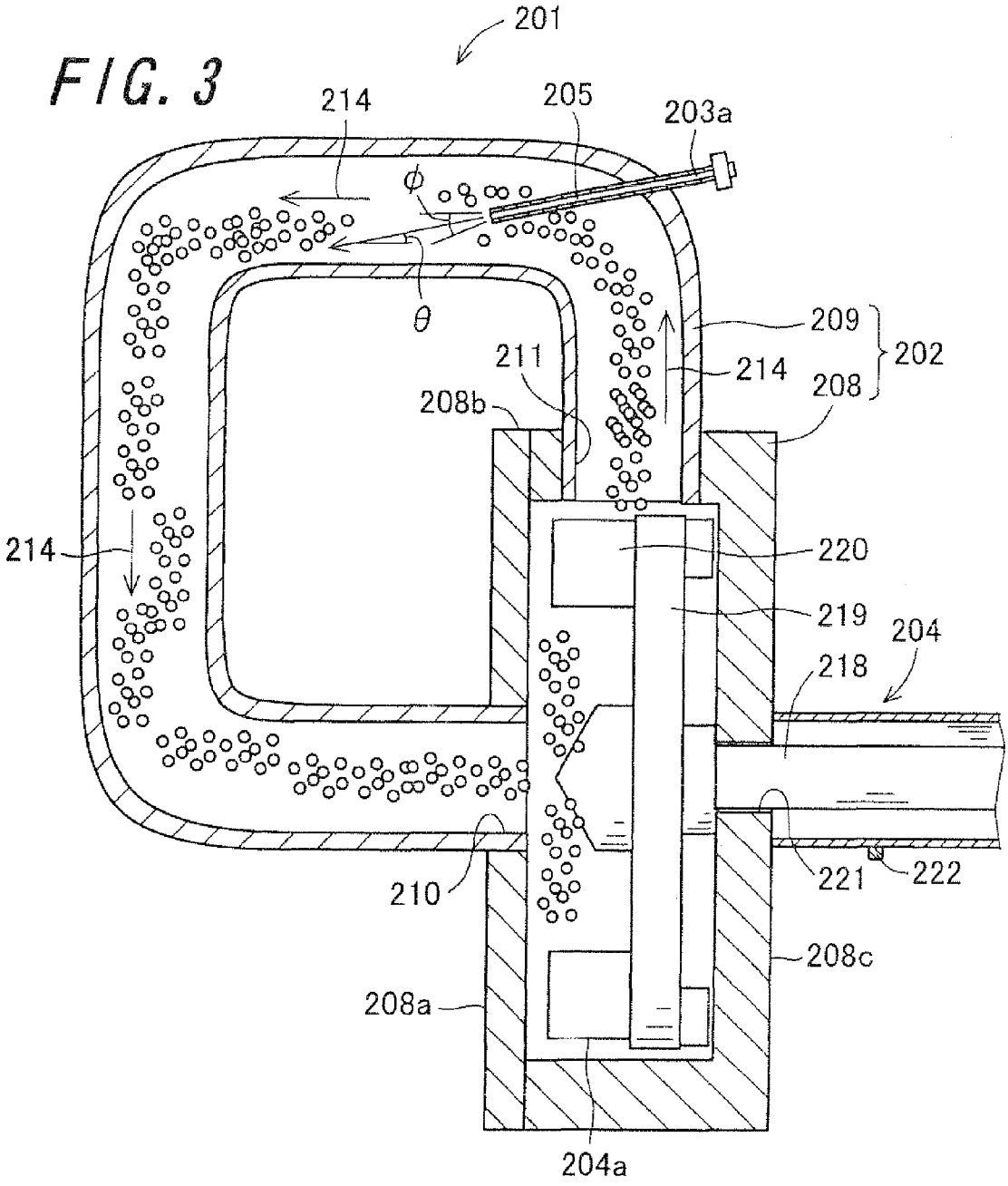
FIG. 3 is a sectional view of the toner manufacturing apparatus cut along the cross-sectional line A200-A200.
Figure 4:
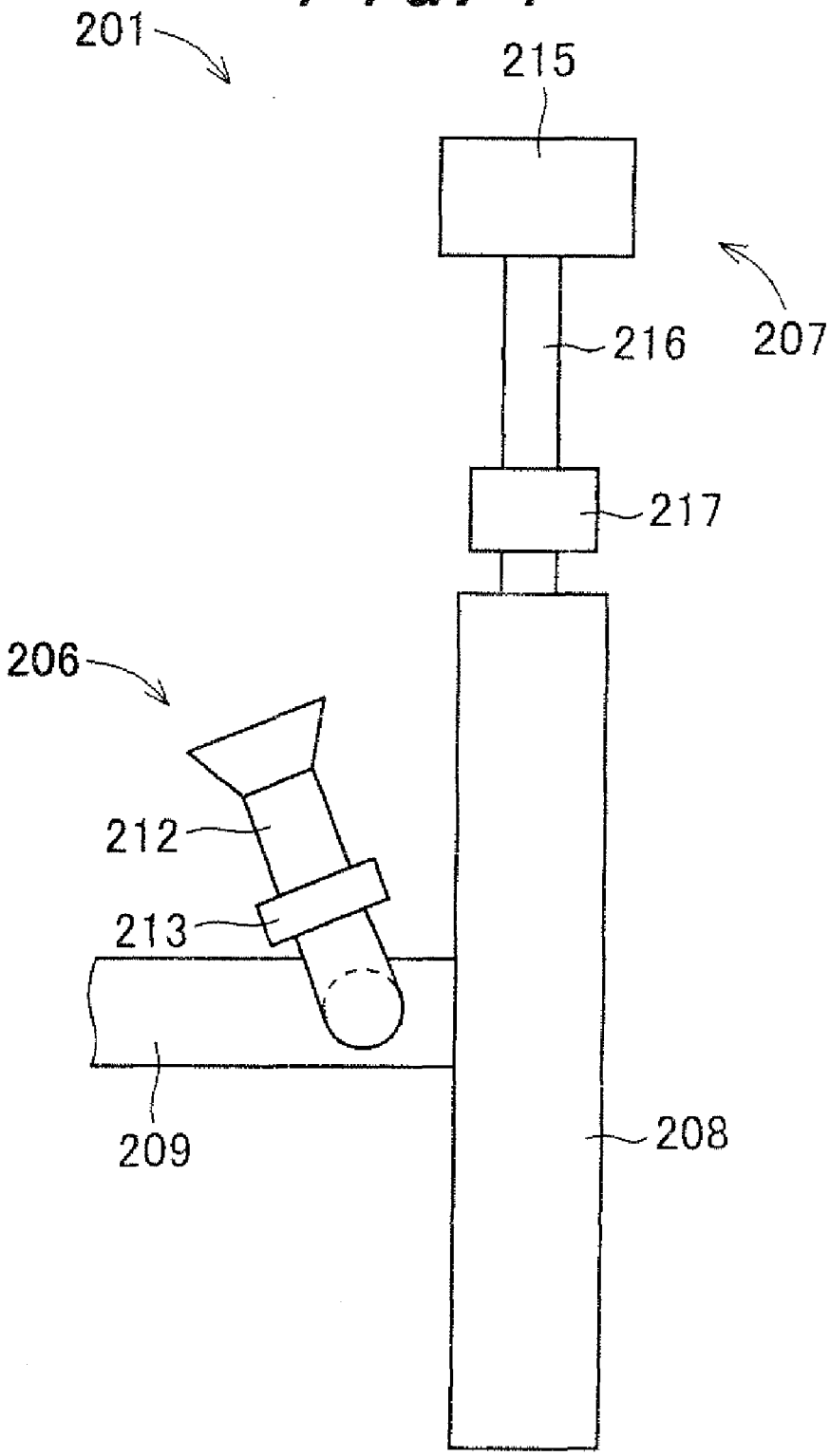
FIG. 4 is a side view of the toner manufacturing apparatus.

FIG. 2 is a front view of the toner manufacturing apparatus 201. FIG. 3 is a sectional view of the toner manufacturing apparatus 201 cut along the cross-sectional line A200-A200. FIG. 4 is a side view of the toner manufacturing apparatus 201. The toner manufacturing apparatus 201 comprises a powder passage 202, a spraying section 203, a rotary stirring section 204, a powder inputting section 206, a powder collecting section 207, and a temperature regulation jacket (not shown).

The powder passage 202 has an internal space for fluidizing toner core particles, fine resin particles, carrier gas and the like. The powder passage 202 comprises a stirring chamber 208 and a powder flowing section 209.

The stirring chamber 208 is a cylindrical container-like member having an internal space. In the stirring chamber 208, opening sections 210 and 211 are formed. The opening section 210 is formed at an approximate center part of a wall section 208*a* which is one end wall section in the axial direction of the stirring chamber 208 so as to penetrate the wall section 208*a* in its thickness direction. The opening section 211 is formed to penetrate a wall section 208*b* which is perpendicular to the wall section 208*a* of the stirring chamber 208 in its thickness direction. Furthermore, in the stirring chamber 208, a through-hole 221 is formed. The through-hole 221 is formed so as to penetrate a wall section 208*c* which is a wall section parallel to the wall section 208*a* of the stirring chamber 208 in its thickness direction. Additionally, in the stirring chamber 208, the rotary stirring section 204 is provided.

The rotary stirring section 204 includes a rotary shaft section 218, a discotic rotary disc 219, a plurality of stirring blades 220, and a gas discharging section 222. The rotary shaft section 218 is a cylindrical-bar-shaped member that has an axis matching an axis of the stirring chamber 208, that is provided so as to be inserted in the through-hole 221, and that is rotated around the axis by a driving motor (not shown). The rotary shaft member 218 rotates by applying current to the driving motor. In the rotary shaft section 218, an ammeter (not shown) is provided and a current value of current applied to the driving motor is able to be measured.

The rotary shaft section 218 is rotatable at peripheral speed of 50 m/sec or more in an outermost periphery of the rotary stirring section 204. The outermost periphery of the rotary stirring section 204 is a part 204*a* of the stirring blades 220 that has the longest distance from the axis of the rotary shaft section 218 in the direction perpendicular to the extending direction of the rotary shaft member 218.

Moreover, the rotary shaft section 218 is a carrier gas supplying section that supplies carrier gas in the stirring chamber 208. In the rotary shaft section 218, a carrier gas supplying amount control section (not shown) is provided, and it is possible to adjust the supplying amount per unit time of the supplying carrier gas. Furthermore, in the rotary shaft section 218, a float type flowmeter (not shown) is provided and the supplying amount of the carrier gas is able to be measured. The rotary shaft section 218 is capable of preventing toner particles or the like to be discharged to the outside of the powder passage 202 from the gas discharging section 222 by sending carrier gas into the stirring chamber 208. Whereby a yield of toner is prevented from reducing, the flowing of toner into the driving motor is prevented, and increase of the consumption power due to increase of the torque, breakdown of the driving motor and the like are able to be prevented. For the carrier gas, compressed air or the like is usable.

A rotary disc 219 is a discotic member having the axis supported by the rotary shaft section 218 so as to match the axis of the rotary shaft section 218 and rotating with rotation of the rotary shaft section 218. The plurality of stirring blades 220 are members that are supported by the rotary disc 219 and rotates with the rotation of the rotary disc 219. The rotary shaft section 218, the rotary disc 219 and the stirring blade 220 are the rotary stirring section that imparts impact force to powder, carrier gas and the like by rotary stirring so that power, carrier gas and the like are fluidized in the powder passage 202. Powder, carrier gas and the like are, as shown by an arrow 214, fluidized so as to go out the stirring chamber 208 from the opening section 211 and enter into the stirring chamber 208 from the opening section 210.

The gas discharging section 222 is a discharging section that discharges gas in the powder passage 202. The gas in the powder passage 202 is comprised of carrier gas, vapor of a spray liquid sprayed by the spraying section 203, which will be described below, and the like. By discharging the spray liquid by way of the gas discharging section 222, a drying speed is increased and aggregation of powder due to an undried spray liquid can be prevented. Additionally, in the gas discharging section 222, a gas detector (not shown) is provided and the density of vapor of the spray liquid in the gas discharged to the outside of the powder passage 202 is able to be measured. A plurality of gas detectors may be provided.

The powder flowing section 209 is a cylindrical member having an internal space, one end thereof is connected to the opening section 210 and the other end is connected to the opening section 211. Whereby the internal space of the stirring chamber 208 communicates with the internal space of the powder flowing section 209, and the powder passage 202 is formed. In the powder flowing section 209, the spraying section 203, the powder inputting section 206 and the powder collecting section 207 are provided.

The powder inputting section 206 includes a hopper (not shown) that supplies the toner core particles and the fine resin particles, a supplying tube 212 that communicates the hopper and the powder passage 202, and an electromagnetic valve 213 provided in the supplying tube 212. The toner core particles and the fine resin particles supplied from the hopper are supplied to the powder passage 202 through the supplying tube 212 in a state where the passage in the supplying tube 212 is opened by the electromagnetic valve 213. The toner core particles and the fine resin particles supplied to the powder passage 202 flow in the flowing direction indicated by an arrow 214 with stirring by the rotary stirring section 204. Moreover, the toner core particles and the fine resin particles are not supplied to the powder passage 202 in a state where the passage in the supplying tube 212 is closed by the electromagnetic valve 213.

The powder collecting section 207 includes a collecting tank 215, a collecting tube 216 that communicates the collecting tank 215 and the powder passage 202, and an electromagnetic valve 217 provided in the collecting tube 216. The toner particles flowing through the powder passage 202 are collected in the collecting tank 215 through the collecting tube 216 in a state where the passage in the collecting tube 216 is opened by the electromagnetic valve 217. Moreover, the toner particles flowing in the powder passage 202 are not collected in a state where the passage in the collecting tube 216 is closed by the electromagnetic valve 217.

The spraying section 203 is a spraying section that is provided in the vicinity of the opening section 211 of the powder flowing section 209. The spraying section 203 includes a liquid reservoir (not shown), a carrier gas supplying section (not shown), a two-fluid nozzle 205, and a spraying amount control section (not shown).

Carrier gas supplying section is a carrier gas supplying section that supplies carrier gas into the powder flowing section 209. In the carrier gas supplying section, a float type flowmeter (not shown) is provided and the supplying amount of the carrier gas is able to be measured.

The liquid reservoir retains the spray liquid. In addition, the liquid reservoir includes a liquid feeding pump (not shown) and feeds a volatile liquid of an amount of a set value to the two-fluid nozzle 205.

The spray liquid retained in the liquid reservoir is to plasticize the fine resin particles. The spray liquid is preferably not to dissolve toner core particles and fine resin particles. Moreover, although the spray liquid plasticizing fine resin particles without dissolving is not particularly limited, from a point that being removed after spraying the spray liquid, is preferably a volatile liquid that is easily vaporized.

The volatile liquid preferably contains lower alcohol. As lower alcohol, for example, methanol, ethanol, propanol, butanol and the like are included. The contained amount of the lower alcohol is, in order to be evaporated sufficiently quickly and plasticize fine resin particles sufficiently, preferably 90% or more relative to the entire volatile liquid. By using the volatile liquid including such lower alcohol, it is possible to enhance wettability of the fine resin particles with respect to the toner core particles. Whereby, adhesion, deformation and film-forming of the fine resin particles are easily performed over the entire surface or a large part of the toner core particles.

Further, since the alcohol has a high drying speed, the time taken for removing the volatile liquid is able to be further shortened. Whereby, aggregation of toner core particles is able to be suppressed. Additionally, the volatile liquid containing alcohol is hard to dissolve resin, thus dissolving of the toner core particles is able to be suppressed.

Further, as lower alcohol, it is preferable to select alcohol whose boiling point is within ±20° C. of glass transition point of the fine resin particles. The boiling point of the alcohol included in the volatile liquid is within the range of ±20° C. of glass transition point of the fine resin particles, the alcohol is evaporated speedily near the glass transition point of the fine resin particles, and temperature rise of the fine resin particles are able to be suppressed effectively.

Further, the viscosity of the volatile liquid is preferably 5 cP or less. Here, the viscosity of the volatile liquid is a value measured at 25° C. The viscosity of the volatile liquid can be measured, for example, by a cone/plate type rotation viscometer. A preferable example of the volatile liquid having the viscosity of 5 cP or less includes the alcohol mentioned above (such as methanol or ethanol). These alcohols have the low viscosity and are easily vaporized, and therefore, minute spraying is possible without coarsening a diameter of the spray droplet to be sprayed from the spraying section 203. Thereby, it is possible to spray the liquid with a uniform droplet diameter. It is also possible to further promote fining of the droplet by the collision of the toner core particles and the droplet. This makes it possible to manufacture a toner in which a resin layer whose thickness is uniform by wetting and acclimating the surfaces of the toner core particles and the fine resin particles and softening the fine resin particles by a synergetic effect with the volatile liquid and collision energy.

Therefore, by using the volatile liquid containing alcohol as a spray liquid, a resin layer whose thickness is uniform is able to be formed on the surface of the toner core particle. Furthermore, it is possible to suppress generation of aggregate by the toner core particles and the fine resin particles, and adhesion of the toner core particles and the fine resin particles to the inner wall surface of the toner manufacturing apparatus 201.

The two-fluid nozzle 205 is provided as being inserted to an opening formed on an outer wall of the powder passage 202. The two-fluid nozzle 205 mixes the spray liquid and the carrier gas, and sprays the mixture into the powder passage 202. An angle θ formed by the spraying direction of the spray liquid from the two-fluid nozzle 205 and the flowing direction of the powder is preferably 0° or more and 45° or less. Here, the spraying direction of the spray liquid is a direction of the axis of the two-fluid nozzle 205. In a case where the angle θ falls within this range, the droplet of the spray liquid is prevented from recoiling from the inner wall of the powder passage 202 and a yield of the toner core particles (toner particles) in which a resin layer is formed on the surface thereof is able to be further improved.

In a case where the angle θ exceeds 45°, the droplet of the spray liquid easily recoils from the inner wall of the powder passage 202 and the spray liquid is easily retained. Thus generating aggregation of the toner core particles and deteriorating the yield of the toner. The two-fluid nozzle 205 is more preferably provided so as to be the angle θ=0°, that is such that the flowing direction of the powder is parallel to the spraying direction of the spray liquid. Thereby, the spray droplets from the spray section 203 flow in the same direction as the powder, and the recoil is able to be further suppressed.

Further, a spreading angle ϕ of spray by the two-fluid nozzle 205 is preferably 20° or more and 90° or less. In a case where the spreading angle ϕ falls out of this range, it is difficult to spray the spray liquid uniformly to the toner core particles.

The spraying amount control section adjusts the spraying amount per unit time of the spray liquid supplied from the liquid reservoir, and the supplying amount per unit time of the carrier gas supplied from the carrier gas supplying section respectively.

The temperature regulation jacket is provided at least on a part of wall section of the powder passage 202. The temperature regulation jacket is provided on an outer wall surface of the wall section of the powder passage 202, temperature in the powder passage 202 is regulated to be constant by passing a cooling medium or a heating medium through the internal space of the jacket, and adhesion of the toner core particles is prevented. The temperature regulation jacket is preferably provided on a part of the wall section of the powder passage 202 in which the toner core particles easily adhere.

For example, the temperature regulation jacket is provided on a part of the wall section of the powder flowing section 209, which is in downstream of the flowing direction of the spraying section 203. By providing the temperature regulation jacket in this manner, a state in which the sprayed spray liquid is retained without being dried is prevented. Thus, adhesion of the toner core particles to the inner wall face of the powder passage 202 and the aggregation of the toner core particles are able to be prevented.

Additionally, the temperature regulation jacket is provided on a part of the wall section of the stirring chamber 208, near the opening section 210. By providing the temperature regulation jacket in this manner, the toner core particles are prevented from being adhered to the vicinity of the opening section 210 by collision of the toner core particles that flow from the opening section 210 into the stirring chamber 208 with the toner core particles that flow into the stirring chamber 208. Furthermore, the temperature regulation jacket is preferably provided on the entire wall section of the powder flowing section 209 and a part of the wall section of the stirring chamber 208, and more preferably provided on the entire wall section of the powder passage 202. By providing the temperature regulation jacket in this manner, it is possible to prevent the toner core particles from being adhered to the inner wall surface of the powder passage 202 more reliably.

The toner manufacturing apparatus 201 as described above can be also obtained by combining a commercially available stirring apparatus and the spraying apparatus. Examples of the commercially available stirring apparatus provided with a powder passage and a rotary stirring section include HYBRIDIZATION SYSTEM (trade name) manufactured by Nara Machinery Co., Ltd. By installing a spraying apparatus spraying the spray liquid in the stirring apparatus, the stirring apparatus is usable as the toner manufacturing apparatus 201 used for the toner manufacturing process.

(3) Temperature Regulation Step S2

At the temperature regulation step S2, while the rotary stirring section 204 is rotated, a temperature in the powder passage 202 is regulated to an initial temperature at the stirring step S3. At the temperature regulation step S2, the rotary stirring section 204 is rotated at a predetermined rotation speed except for the starting period of the temperature regulation step S2.

The temperature in the powder passage 202 is regulated by passing a temperature regulation medium such as water through the temperature regulation jacket disposed on the outer wall surface of the wall section of the powder passage 202. This makes it possible to control the temperature in the powder passage 202 to a temperature at which the toner core particles and the fine resin particles that are inputted at the stirring step S3 are not softened and deformed.

At the temperature regulation step S2, the temperature in the powder passage 202 is preferably regulated to be 55° C. or lower. Whereby, it is possible to sufficiently disintegrate the secondary aggregate of the fine resin particles at the stirring step S3. Moreover, after disintegrating the fine resin particles, by using the temperature rise in the powder passage 202 due to the stirring of the toner core particles and the fine resin particles, it is possible to adhere and immobilize the fine resin particles on the surfaces of the toner core particles. Accordingly, at the spraying step S4, it is possible to form a resin layer whose thickness is further uniform on the surface of the toner core particle. Furthermore, at the stirring step S3, it is possible to prevent adhesion of the toner core particles and the fine resin particles to the inside of the rotary stirring section 204 and the powder passage 202, and the yield of the toner is able to be further improved.

In the present embodiment, time taken for the temperature regulation step S2 is for 1 minute to 3 minutes, and the temperature in the powder passage 202 during the temperature regulation step S2 is regulated to be 15° C. to 30° C. by the temperature regulation jacket.

(4) Stirring Step S3

When the temperature regulation step S2 is finished, the stirring step S3 is started. At the stirring step S3, the toner core particles and the fine resin particles are supplied to the powder passage 202 from the powder inputting section 206, and the rotary stirring section 204 is rotated. During the stirring step S3, the rotary stirring section 204 maintains the predetermined rotation speed at the temperature regulation step S2, and rotates at a constant rotation speed.

The toner core particles and the fine resin particles supplied to the powder passage 202 are stirred by the rotary stirring section 204 and fluidized in the powder flowing section 209 in a direction indicated by the arrow 214. At this time, since the toner core particles are fluidized with the fine resin particles, the fine resin particles are adhered to the surface of the toner core particle.

More specifically, the fine resin particles inputted as the secondary aggregate circulate in the powder passage 202 by the rotary stirring section 204. While inputting and immediately after the completion of inputting the fine resin particles into the powder passage 202, the fine resin particles to which the impact force is imparted by the rotary stirring section 204 are disintegrated into fine particles whose size is close to that of primary particles.

When the fine resin particles are disintegrated, the number of powder in the powder passage 202 is increased, and the viscosity of the powder increases, thus a load applied to the rotary stirring section 204 increases. After completion of inputting the toner core particles and the fine resin particles, at the stirring step S3, the total mass of the powder existed in the powder passage 202 does not change, thus the load applied to the rotary stirring section 204 is only affected by the number of powder. Hereinafter, at the stirring step S3, the load applied to the rotary stirring section 204 is defined as F.

On the other hand, in a case where only the toner core particles are inputted into the powder passage 202 while each of the conditions at the stirring step S3 such as the temperature in the powder passage 202 and the rotation speed of the rotary stirring section 204 are remained as the same, the number of the powder hardly increases. That is to say, in a case where the rotary stirring section 204 is rotated at a predetermined rotation speed and only the toner core particles are fluidized in the powder passage 202 as powder, when the load applied to the rotary stirring section 204 is $F_{core}$ $F_{core}$ is a constant value, except for during inputting and immediately after the completion of inputting the toner core particles.

Furthermore, in a case where powder is not inputted under the same conditions, that is, in a case where the rotary stirring section 204 is rotated at the predetermined rotation speed and rotated at idle, when the load applied to the rotary stirring section 204 is $F_0$, $F_0$ is naturally a constant value. From the load F, $F_{core}$ and $F_0$, it is understood that $F_{core}$ and $F_0$, $(F-F_0)$ shows an increased amount of the load applied to the rotary stirring section 204 at the stirring section S3, and $(F_{core}-F_0)$ shows an increased amount of the load applied to the rotary stirring section 204 by the toner core particles.

The load F (and $F_{core}$, $F_0$) applied to the rotary stirring section 204 is rotation force whose force is same as and a direction is different from torque applied to the rotary stirring section 204 to rotate the rotary stirring section 204 at a constant rotation speed. Thus; by measuring the torque applied to the rotary stirring section 204, these loads are able to be measured.

Furthermore, between the force of the toque and a current value applied to the driving motor provided with the rotary stirring section 204, proportional relation holds. Therefore, when the current value is I, the following formula holds.

$$I=\alpha F(\alpha \text{ is a proportionality constant})$$

Accordingly, when the current value I is measured, the load F (and $F_{core}$, $F_0$) are also able to be measured. Compared with a case of measuring the torque applied to the rotary stirring section 204, it is possible to measure the load F (and $F_{core}$, $F_0$) more easily and accurately in the case of measuring the current value I, thus it is preferable to measure the load F (and $F_{core}$, $F_0$ by the current value I. In the present embodiment, the load F (and $F_{core}$, $F_0$) is measured by the current value I measured by an ammeter attached to the driving motor of the rotary shaft section 218.

Depending on various conditions of the toner manufacturing apparatus 201, the proportionality constant α varies, but when the proportionality constant α is "1", F=1. Moreover, when the proportionality constant α is "1", and an index of F and an index of I are identical, the value of F and the value of I are equal. That is, $F_{core}=I_{core}$, and $F_0=I_0$.

As described above, since the rotary stirring section 204 rotates at a constant rotation speed at the stirring step S3, when the load F increases, the torque (and the current value I) increases. Thus, when the load F increases, energy consumed by the toner manufacturing apparatus 201 increases. The consumed energy appears as a temperature rise in the powder passage 202 as a result. That is, when the rotary stirring section 204 rotates at a constant rotation speed, and the current value I is on the increase, the temperature in the powder passage 202 is on the rise.

In this manner, at the stirring step S3, the temperature in the powder passage 202 rises compared with the temperature regulation step S2. At the stirring step S3, the fine resin particles are adhered to the surfaces of the toner core particles by a synergetic effect with not only impact force imparted by the rotary stirring section 204 but also plasticization of the fine resin particles accompanied by the rise of the temperature in the powder passage 202. Note that, when adhesion of the fine resin particles proceeds and the number of powder in the powder passage 202 decreases, the load F is reduced and the current value I is also reduced.

At the stirring step S3, the temperature in the powder passage 202 is preferably not higher than a glass transition point of the fine resin particles. Furthermore, the temperature in the powder passage 202 is more preferably not higher than a glass transition point of the toner core particles. Whereby, the secondary aggregate of the fine resin particles are able to be stably disintegrated. Moreover, excessive softening of the toner core particles and the fine resin particles due to rise of the temperature in the powder passage 202 caused by flowing and stirring of the toner core particles and the fine resin particles, is able to be suppressed. Thereby, aggregation of the toner core particles and fine resin particles as well as adhesion of the toner core particles and the fine resin particles to the inner wall surface of the powder passage 202 are able to be prevented.

In the present embodiment, time taken for the stirring step S3 is for 5 minutes to 15 minutes, and the temperature in the powder passage 202 in the stirring step S3 is regulated to 30° C. to 60° C. by the temperature regulation jacket.

Furthermore, at the stirring step S3, the toner core particles and the fine resin particles preferably collide with the rotary disc 219 perpendicularly to the rotary disc 219, more preferably collide with the rotary shaft section 218 perpendicularly to the rotary disc 219. Whereby, the toner core particles and the fine resin particles are sufficiently stirred compared with a case where the toner core particles and the fine resin particles collide parallel with the rotary disc 219. Accordingly, the fine resin particles adhere to the surfaces of the toner core particles more uniformly. Thus, a toner in which a more uniform resin layer is formed on the surface of the toner core particle is able to be obtained.

(5) Spraying Step S4

When the stirring step S3 is finished, the spraying step S4 is started. At the spraying step S4, first, while rotating the rotary stirring section 204, a spray liquid is sprayed from the spraying section 203. At the spraying section S4, the rotation speed of the rotary stirring section 204 may be constant as the stirring section S3, or may be changed in the middle of the spraying step S4.

The starting period of the spraying step S4 is during rotation of the rotary stirring section 204, after a completion of inputting the fine resin particles into the powder passage 202, and within a period satisfying the following formula (1).

$$1.7 \leqq (F-F_0)/(F_{core}-F_0) \leqq 5.7 \quad (1)$$

(hereinafter, $(F-F_0)/(F_{core}\ F_0)$ is defined as f and referred to as "load coefficient f".)

Note that, starting of the spraying step S4 equals to starting of spraying of a spray liquid by the spraying section 203.

By spraying the spray liquid from the spraying section 203 to the toner core particles and fine resin particles in a state of flowing in the powder passage 202, the spray liquid is adhered to their respective surfaces. Whereby, the toner core particles and the fine resin particles are plasticized. The plasticized fine resin particles on the surfaces of the toner core particles are softened and deformed by a synergetic effect with impact force imparted by the rotary stirring section 204 and thermal energy applied by flowing in the powder passage 202 and stirring by the rotary stirring section 204, and becomes a continuous film on the surface of the toner core particle. In this manner, a resin layer is formed on the surface of the toner core particle.

At this time, when there remains the fine resin particles which are flowing in an isolated state without adhering to the toner core particles, immobilization of the fine resin particles to the surfaces of the toner core particles proceeds, and the number of powder in the powder passage 202 is reduced. Accordingly, even though the rotary stirring section 204 is rotated at a constant rotation speed, the temperature in the powder passage 202 becomes hard to rise. Furthermore, at this time, the spray liquid is evaporated and thermal energy in the powder passage 202 is lost. Whereby, the temperature in the powder passage 202 becomes hard to rise.

However, when starting of the spraying step S4 is too late, the temperature in the powder passage 202 rises excessively, and melting of the toner core particles occurs. As a result, additives such as a release agent contained in the toner core particle exude into the resin layer of the surface of the toner core particle. When such exuding of the release agent (hereinafter, referred to as "wax bleed") occurs, characteristics of the toner such as fluidity and preservation stability are remarkably deteriorated.

On the other hand, when starting of the spraying step S4 is too early, the fine resin particles are plasticized before a sufficient amount of the fine resin particles are adhered to the surfaces of the toner core particles. The plasticized fine resin particles become easy to adhere to not only the surfaces of the toner core particles but also the inner wall surface of the powder passage 202. Thus, before a sufficient amount of the fine resin particle is adhered to the surface of the toner core particle, formation of the resin layer is performed. As a result, a toner becomes one in which the thickness of the resin layer is non-uniform.

Consequently, the spraying step S4 is required to be started in a state where a sufficient amount of the fine resin particles are adhered to the surfaces of the toner core particles and before the wax bleed occurs. However, an adhesion progress of the fine resin particles to the surfaces of the toner core particles and the time when the wax bleed occurs vary depending on the characteristics of the fine resin particles, characteristics of the toner core particles and the condition of operation of the toner manufacturing apparatus 201, and it is difficult to determine those with the conventional method.

Particularly, concerning the fine resin particles, depending on the size of the secondary aggregate, size and shape of the fine particles after disintegration vary, and the adhesion progress of the fine resin particles is affected by the size and shape of the fine particles after disintegration. Since the size of the secondary aggregate of the fine resin particles has variation depending on a drying state, preserving condition, when the spraying step S4 is started at the same period all the time, a possibility of manufacturing a toner whose characteristics are deteriorated is high.

As described above, the load F (and current value I) and adhesion progress of the fine resin particles are closely associated. Moreover, the load F is also associated with the temperature in the powder passage 202, there is an association between the load F and the time when the wax bleed occurs. Note that, the load F varies depending on various conditions such as condition of powder, condition of the toner manufacturing apparatus 201. Therefore, the starting period of the spraying step S4 is not determined according to the force of the load F.

In the present embodiment, the starting period of the spraying period is determined by the load coefficient f. The load coefficient f is a ratio between an increased amount $(F-F_0)$ of the load applied to the rotary stirring section 204 at the stirring section S3 and an increased amount $(F_{core}-F_0)$ of the load applied to the rotary stirring section 204 by the toner core particles. Therefore, the load coefficient f is an index that shows the adhesion progress of the fine resin particles without depending on the condition of powder.

Further, when the load F is represented by the current value I, a value of the proportionality constant $\alpha$ is required, however the load coefficient f does not depend on the proportionality constant $\alpha$. That is, the load coefficient f does not depend on the condition of the toner manufacturing apparatus 201.

Specifically, in the present embodiment, when the load coefficient f is 5.7 or less, the spraying step S4 is started. That is, irrespective of the size of the secondary aggregate of the fine resin particles inputted to the toner manufacturing apparatus 201, after the fine resin particles disintegrated from the state of secondary aggregate are sufficiently adhered to the surfaces of the toner core particles, spraying of the spray liquid that plasticizes the fine resin particles is started.

Furthermore, when the load coefficient f is 1.7 or more, the spraying step S4 is started. That is, before melting of the toner core particles and the fine resin particles proceeds due to the excessive heating, spraying of the spray liquid that plasticizes the fine resin particles is started. Therefore, exuding of the additives such as a release agent contained in the toner core particles into the surfaces of the toner core particles is able to be prevented.

In this manner, according to the present embodiment, a toner whose characteristics such as fluidity and preservation stability are excellent and in which a resin layer whose thickness is uniform is formed on the surface of the toner core particle is able to be manufactured.

Further, the starting period of the spraying step S4 is preferable to be during rotation of the rotary stirring section, after inputting the fine resin particles into the powder passage, and within a period satisfying the following formula (2).

$$2.15 \leqq (F \leqq F_0)/(F_{core}-F_0) \leqq 4.15 \quad (2)$$

(as described above, $(F-F_0)/(F_{core}-F_0)$ is defined as f and referred to as "load coefficient f")

In a case where the spraying step S4 is started when the load coefficient f is 4.15 or less, spraying of the spray liquid that plasticizes the fine resin particles is started after the fine resin particles that are disintegrated from the secondary aggregate state are sufficiently adhered to the surfaces of the toner core particles. Further, in a case where the spraying step S4 is started when the load coefficient f is 2.15 or more, spraying of the liquid that plasticizes the fine resin particles is started before the toner core particles and fine resin particles are melted.

Accordingly, a toner whose characteristics such as fluidity and preservation stability are excellent and in which a resin layer whose thickness is uniform is formed on the surface of the toner core particle is able to be manufactured.

Further, the spraying step S4 is preferable to be started after the flowing speed of the toner core particles and fine resin particles in the powder passage 202 is stabilized. Whereby, a spray liquid is able to be sprayed to the toner core particles and the fine resin particles uniformly. Thus, a toner in which a resin layer whose thickness is further uniform is formed on the surface of the toner core particle is able to be manufactured.

In spraying the spray liquid at the spraying step S4, carrier gas is supplied to the inside of the powder passage 202 from the spraying section 203 and the rotary shaft section 218. The carrier gas supplied from the spraying section 203 and the rotary shaft section 218 is discharged from the gas discharging section 222 to the outside of the toner manufacturing apparatus 201. At this time, a carrier gas supplying amount from the spraying section 203 and the rotary shaft section 218, and a carrier gas discharging amount from the gas discharging section 222 are preferable to be approximately same.

When the carrier gas discharging amount is too small compared with the carrier gas supplying amount, the vapor concentration of the spray liquid in the gas existed in the toner manufacturing apparatus 201 is risen excessively, and the evaporation of the spray liquid is not to be proceeded. As a result, aggregation of the toner core particles and the fine resin particles may be caused, and the toner core particles or the fine resin particles are adhered to the spray liquid adhered to the inner wall surface of the powder passage 202, whereby accumulation of other particles may be caused by the adhered particles as cores. Furthermore, by the accumulation of the particles, the flowing passage for fluidizing the powder is narrowed, and the toner core particles and the fine resin particles are prevented from being isolated and fluidized, and the thickness of the resin layer becomes further non-uniform.

On the other hand, when the carrier gas discharging amount is too much compared with the carrier gas supplying amount, the flowing out of the powder from the gas discharging section 222 to the outside of the toner manufacturing apparatus 201 is remarkable, and the yield is lowered. Furthermore, flowing into the rotary shaft section 218 of the powder is occurred and enlarging a load to the driving motor, increase of power consumption and the like are caused.

Moreover, the spray liquid sprayed at the spraying step S4 is preferable to be evaporated so as to be a constant vapor concentration in the powder passage 202. Whereby drying speed of the spray liquid is able to be made faster compared with the case where the vapor concentration is not maintained to be constant. Thus, aggregation of the toner core particles by the undried spray liquid is able to be suppressed. Accordingly, the yield of toner is able to be further improved.

At this time, vapor of the spray liquid in the powder passage 202 is preferably discharged to the outside of the powder passage 202 with the carrier gas. Thereby the vapor concentration in the powder passage 202 is able to be maintained to be constant.

The vapor concentration of the spray liquid measured in the gas discharging section 222 is preferable to be 10% or less, and more preferably 0.1% or more and 3.0% or less. When the vapor concentration of the spray liquid is in this range, aggregation of the toner core particles is able to be prevented without reducing productivity of a toner.

At the spraying step S4, even after the completion of spraying of the spray liquid, the rotary stirring section 204 keeps rotating for a predetermined time and the toner core particles and the fine resin particles circulate repeatedly in the powder passage 202. After rotation of the rotary stirring section 204 during the predetermined time, rotation of the rotary stirring section 204 stops.

Through the spraying step S4, the temperature in the powder passage 202 is preferably not higher than a glass transition point of the toner core particles, and more preferably 30° C. or higher and not higher than a glass transition point of the toner core particles. The temperature in the powder passage 202 is approximately uniform at any part in the powder passage 202 by flowing of the toner core particles. When the temperature in the powder passage 202 exceeds the glass transition point of the toner core particles, the toner core particles are too much softened in the powder passage 202 and aggregation of the toner core particles occurs. Furthermore, when the temperature in the powder passage 202 is lower than 30° C., the drying speed of the spray liquid becomes slow and the productivity of the toner is reduced.

In the present embodiment, time taken for spraying the spray liquid is for 10 minutes to 45 minutes, and thereafter a predetermined time in which the rotary stirring section 204 rotates is for 5 minutes to 15 minutes. Furthermore, in the present embodiment, the temperature in the powder passage 202 in the spraying step S4 is regulated to 40° C. to 60° C. by the temperature regulation jacket.

(6) Collecting Step S5

After the spraying step S4 is finished, the collecting step S5 is started. At the collecting step S5, toner core particles (toner particles) in which a resin layer is formed on the surface thereof are discharged to the outside of the toner manufacturing apparatus 201 and collected by the powder collecting section 207. In the present embodiment, time taken for the collecting step S5 is for 1 minute to 2 minutes, and the temperature in the powder passage 202 in the collecting step S5 is regulated to 30° C. to 50° C. by the temperature regulation jacket.

In this manner, according to the toner manufacturing process comprised of the steps S1 to S5, since the secondary aggregate of the fine resin particles is disintegrated at the stirring step S3 before the spraying step S4, the fine resin particles in the disintegrated state are adhered to the surfaces of the toner core particles. Thereafter, the fine resin particles are spread on by spraying of the spray liquid, and the thickness of the resin layer is able to be uniform and exposure of the surface of the toner core particle is able to be prevented.

When the spray liquid is sprayed to the toner core particles and the fine resin particles in a state where the secondary aggregate of the fine resin particles has not been disintegrated, the aggregated fine resin particles adhere to the surface of the toner core particle to form a film, and the resin layer whose thickness is non-uniform is formed.

Furthermore, at the toner manufacturing process, it is preferable that after inputting of the toner core particles is completed and after the load applied to the rotary stirring section 204 becomes $F_{core}$ and stabilized, inputting of the fine resin particles is started. Thereby, since the processing is able to be performed in a state where flowing of the toner core particles is stabilized, the secondary aggregate of the fine resin particles is able to be disintegrated more finely at the stirring step S3, and the thickness of the resin layer is able to be further uniform.

Moreover, through the steps S2 to S4, peripheral speed in the outermost periphery of the rotary stirring section 204 is preferably 30 m/sec or more, and more preferably 50 m/sec or more. When the peripheral speed in the outermost periphery is 30 m/sec or more, sufficient impact force is imparted to the powder, and the resin layer whose thickness is further uniform is able to be formed.

Furthermore, according to the present embodiment, as the temperature regulation step S2 is performed, prior to the performance of the stirring step S3, the temperature in the powder passage 202 is regulated to a suitable temperature. Whereby, at the stirring step S3 or later, while adhesion of the toner core particles and the fine resin particles to the inner wall surface of the powder passage 202 is further suppressed, the resin layer whose thickness is uniform is able to be formed.

Furthermore, in the present embodiment, manufacturing of a toner is performed by using the toner manufacturing apparatus 201 provided with the temperature regulation jacket, by passing a heating medium or a cooling medium inside the jacket, regulation of the temperature in the powder passage 202 in each of the steps S2 to S5 is able to be performed.

Specifically, at the stirring step S3, by regulating the inside of the powder passage 202 to a predetermined temperature, the fine resin particles are able to be adhered to the surfaces of the toner core particles at a temperature that the toner core particles and the fine resin particles are not softened and deformed. Whereby, adhesion of the fine resin particles to the toner core particles is able to be proceeded smoothly. Therefore, at the subsequent spraying step S4, the resin layer whose thickness is uniform is able to be formed. Furthermore, at the stirring step S3, by performing regulation of the temperature in the powder passage 202, adhesion of the toner core particles and the fine resin particles to the inner wall surface of the powder passage 202 are able to be suppressed. Whereby, it is possible to be prevented that the inside of the powder passage 202 is narrowed by the toner core particles and the fine resin particles.

Furthermore, specifically, at the spraying step S4, by regulating the inside of the powder passage 202 to a predetermined temperature, variation in the temperatures of the toner core particles, the fine resin particles and the spray liquid is able to be reduced. Whereby, the toner core particles and the fine resin particles are able to be stably fluidized. Additionally, at the spraying step S4, by performing regulation of the temperature in the powder passage 202, adhesion of the toner core particles and the fine resin particles to the inner wall surface of the powder passage 202 due to excessive temperature rise is able to be suppressed. Furthermore, adhesion of the toner core particles and the fine resin particles to the inner wall surface of the powder passage 202 due to retention of the spray liquid in the powder passage 202 is able to be prevented.

Further, a stirring stable temperature as the temperature in the powder passage 202 which is stable after a lapse of a constant time from the starting of the step at the stirring step S3 is preferably a spraying stable temperature or lower as a temperature in the powder passage 202 which is stable after a lapse of a constant time from the starting of the step at the spraying step S4. Whereby, at the stirring step S3, the fine resin particles are able to be immobilized on the surfaces of the toner core particles while reducing the exposure of the surfaces of the toner core particles, and at the spraying step S4, spreading processing of the fine resin particles is able to be performed stably. Therefore, a toner in which a fine resin particle layer whose thickness is uniform is formed is able to be manufactured.

Further, the temperature in the powder passage 202 after a lapse of a predetermined time from the starting of the step at the stirring step S3 is preferably not higher than a temperature in the powder passage 202 which is stable after a lapse of the same predetermined time from the starting of the step at the spraying step S4. Whereby, at the stirring step S3, excessive softening of the fine resin particles are able to be suppressed and the secondary aggregate of the fine resin particles are able to be sufficiently disintegrated. Thus, the disintegrated fine resin particles are able to be adhered to the surfaces of the toner core particles uniformly.

Further, whereby, at the spraying step S4, spreading processing of the fine resin particles adhered to the surfaces of the toner core particles is able to be performed stably. Accordingly, a toner in which a fine resin particle layer whose thickness is uniform is formed is able to be manufactured.

2. Toner

A toner according to the invention is obtained by a method of manufacturing a toner according to the invention. An embodiment of a toner according to the invention includes a toner obtained by the toner manufacturing process described above.

A toner obtained by the toner manufacturing process is a toner in which a thickness of a resin layer is uniform and exuding of an additive is suppressed. Accordingly, this toner is, in which enclosed components of toner particles are protected, excellent in durability and preservation stability. Furthermore, in this toner, an adhering amount of the fine resin particles is uniform between the individual toner particles, and therefore the toner characteristics such as charging characteristics are uniform between the individual toner particles. Thus, by using this toner, it is possible to form an image with high definition and high image quality without unevenness in the concentration for a long time.

Further, an external additive may be added to this toner. As the external additive, heretofore known substances can be used including silica and titanium oxide. It is preferred that these external additives be surface-treated with silicone resin and a silane coupling agent. A preferable usage of the external additive is 1 part by weight to 10 parts by weight based on 100 parts by weight of the toner.

3. One-Component Developer

A one-component developer according to the invention includes a toner according to the invention. As an embodiment of the one-component developer according to the invention, one consisting of only the toner described above is included. With such one-component developer, it is possible to form an image with high definition and high image quality without unevenness in the concentration for a long time.

When using the toner described above as the one-component developer, a toner is frictionally charged by using a blade, a fur brush or the like, and the toner is transported by being adhered on a developing sleeve to perform image formation.

4. Two-Component Developer

A two-component developer according to the invention contains a toner according to the invention and a carrier. As an embodiment of the two-component developer according to the invention, one that contains the toner described above and a heretofore known carrier is included. With such two-component developer, it is possible to form an image with high definition and high image quality without unevenness in the concentration for a long time.

As the heretofore known carrier, examples thereof include single or complex ferrite composed of iron, copper, zinc, nickel, cobalt, manganese, and chromium; a resin-coated carrier having carrier core particles whose surfaces are coated with coating substances; and a resin-dispersion carrier in which magnetic particles are, dispersed in resin. As the coating substance, heretofore known substances can be used including polytetrafluoroethylene, a monochloro-trifluoroethylene polymer, polyvinylidene-fluoride, silicone resin, polyester, a metal compound of di-tertiary-butylsalicylic acid, styrene resin, acrylic resin, polyamide, polyvinyl butyral, nigrosine, aminoacrylate resin, basic dyes or lakes thereof, fine silica powder, and fine alumina powder.

In addition, the resin used for the resin-dispersion carrier is not limited to particular resin, and examples thereof include styrene-acrylic resin, polyester resin, fluorine resin, and phenol resin. The resins used for the resin-dispersion carrier are preferably selected according to the toner components. Those resins listed above may be used each alone, and two or more thereof may be used in combination.

A particle of the carrier preferably has a spherical shape or flattened shape. A particle size of the carrier is not limited to a particular diameter, and in consideration of forming higher-quality images, the particle size of the carrier is preferably 10 μm to 100 μm and more preferably 20 μm to 50 μm. Further, the resistivity of the carrier is preferably $10^8 \Omega \cdot cm$ or more, and more preferably $10^{12} \Omega \cdot cm$ or more.

The resistivity of the carrier is obtained as follows. At the outset, the carrier is put in a container having a cross section of 0.50 $cm^2$, thereafter being tapped. Subsequently, a load of 1 $kg/cm^2$ is applied by use of a weight to the carrier particles which are held in the container as just stated. When an electric field of 1,000 V/cm is generated between the weight and a bottom electrode of the container by application of voltage, a current value is read. The current value indicates the resistivity of the carrier. When the resistivity of the carrier is low, electric charges will be injected into the carrier upon application of bias voltage to a developing sleeve, thus causing the carrier particles to be more easily attached to the photoreceptor. In this case, the breakdown of bias voltage is more liable to occur.

Magnetization intensity (maximum magnetization) of the carrier is preferably 10 emu/g to 60 emu/g and more preferably 15 emu/g to 40 emu/g. The magnetization intensity depends on magnetic flux density of a developing roller. Under the condition of ordinary magnetic flux density of the developing roller, however, no magnetic binding force work on the carrier having the magnetization intensity less than 10 emu/g, which causes the carrier to spatter. When the carrier has the magnetization intensity exceeding 60 emu/g, bushes of the carrier are too large, and therefore, in the case of non-contact development, it is difficult to keep the non-contact state with the image bearing member, whereas in the case of contact development, sweeping streaks are liable to appear on a toner image.

A using proportion of the toner and the carrier is not particularly limited, and is selectable as appropriate depending on a type of a toner and a carrier, however, concerning a resin coating carrier (density of 5 g/cm$^2$ to 8 g/cm$^2$) as an example, in the two-component developer, a toner is used so that 2% by weight to 30% by weight, preferably 2% by weight to 20% by weight of a toner relative to a total amount of the two component developer is contained. Furthermore, in the two-component developer, a coating rate of a carrier by a toner is preferably 40% to 80%.

5. Developing Device and Image Forming Apparatus

A developing device according to the invention performs developing by using the one-component developer according to the invention or the two-component developer according to the invention. Furthermore, an image forming apparatus according to the invention is provided with the developing device according to the invention. In the following, description will be given for a developing device 14 as an embodiment of the developing device according to the invention, and an image forming apparatus 100 as an embodiment of the image forming apparatus according to the invention.

Figure 5:
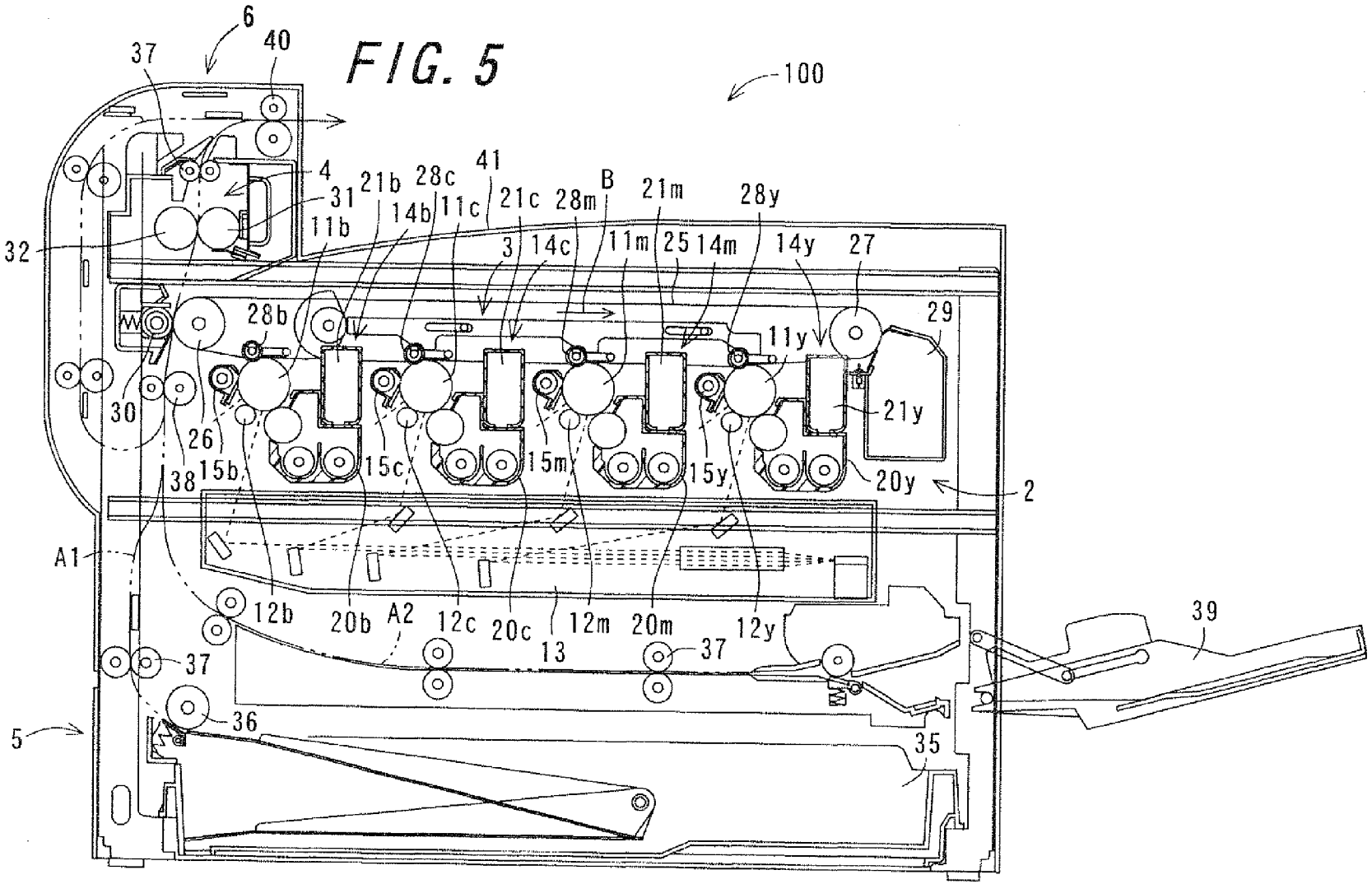
FIG. 5 is a schematic view schematically showing a cross section of an image forming apparatus.

FIG. 5 is a schematic view schematically showing a configuration of an image forming apparatus 100 according to a fourth embodiment of the invention. The image forming apparatus 100 is a multifunctional peripheral which combines a copier function, a printer function, and a facsimile function. In the image forming apparatus 100, according to image information transmitted thereto, a full-color or black-and-white image is formed on a recording medium. That is to say, the image forming apparatus 100 has three print modes of a copier mode, a printer mode, and a facsimile mode, one of which print modes is selected by a control unit (not shown) in response to an operation input given by an operating section (not shown) or a print job given by a personal computer, a mobile computer, an information record storage medium, or an external equipment having a memory unit.

The image forming apparatus 100 includes a toner image forming section 2, a transfer section 3, a fixing section 4, a recording medium feeding section 5, and a discharging section 6. In accordance with image information of respective colors of black (b), cyan (c), magenta (m), and yellow (y) which are contained in color image information, there are provided respectively four sets of the components constituting the toner image forming section 2 and some parts of the components contained in the transfer section 3. The four sets of respective components provided for the respective colors are distinguished herein by giving alphabets indicating the respective colors to the end of the reference numerals. Further, in the case where the respective components are collectively referred to, alphabets are not given to the end of the reference numerals.

The toner image forming section 2 includes a photoreceptor drum 11, a charging section 12, an exposure unit 13, a developing device 14, and a cleaning unit 15. The charging section 12, the developing device 14, and the cleaning unit 15 are disposed in the order just stated around the photoreceptor drum 11. The charging section 12 is disposed vertically below the developing device 14 and the cleaning unit 15.

The photoreceptor drum 11 is supported by a driving section (not shown) so as to be capable of rotationally driving around an axis and includes a conductive substrate (not shown) and a photosensitive layer (not shown) formed on the surface of the conductive substrate. The conductive substrate may be various shapes including a cylindrical shape, a columnar shape, or a thin film sheet shape, for example. Among them, the cylindrical shape is preferable. The conductive substrate is formed by a conductive material. As a conductive material, one commonly used in the field is usable, for example, metals such as aluminum, copper, brass, zinc, nickel, stainless steel, chrome, molybdenum, vanadium, indium, titanium, gold and platinum; alloys formed of two or more thereof; a conductive film in which a conductive layer containing one or two or more of aluminum, aluminum alloy, tin oxide, gold, indium oxide and the like is formed on a film-like substrate such as synthetic resin film, metal film, and paper; and a resin composition containing at least one of conductive particles and conductive polymers. Note that, as the film-like substrate used for the conductive film, a synthetic resin film is preferred and a polyester film is particularly preferred. Further, as the method of forming the conductive layer in the conductive film, vapor deposition, coating and the like are preferred.

The photosensitive layer is formed, for example, by stacking a charge generating layer containing a charge generating substance, and a charge transporting layer containing a charge transporting substance. In this case, an undercoat layer is preferably formed between the conductive substrate and the charge generating layer or the charge transporting layer. When the undercoat layer is provided, the flaws and irregularities present on the surface of the conductive substrate are covered, leading to advantages such that the photosensitive layer has a smooth surface, that chargeability of the photosensitive layer can be prevented from degrading during repetitive use, and that the chargeability of the photosensitive layer can be enhanced under at least either a low temperature circumstance or a low humidity circumstance. Further, a laminated photoreceptor is also applicable which has a highly-durable three-layer structure having a photoreceptor surface-protecting layer provided on the uppermost layer.

The charge generating layer contains as a main substance a charge generating substance that generates charges under irradiation of light, and optionally contains known binder resin, plasticizer, sensitizer and the like. As the charge generating substance, materials used customarily in the relevant field can be used including, for example, perylene pigments such as perylene imide and perylenic acid anhydride; polycyclic quinone pigments such as quinacridone and anthraquinone; phthalocyanine pigments such as metal and non-metal phthalocyanines, and halogenated non-metal phthalocyanines; squalium dyes; azulenium dyes; thiapylirium dyes; and azo pigments having carbazole skeleton, styrylstilbene skeleton, triphenylamine skeleton, dibenzothiophene skeleton, oxadiazole skeleton, fluorenone skeleton, bisstilbene skeleton, distyryloxadiazole skeleton, or distyryl carbazole skeleton. Among those charge generating substances, non-metal phthalocyanine pigments, oxotitanyl phthalocyanine pigments, bisazo pigments containing at least one of fluorene rings and fluorenone rings, bisazo pigments containing aromatic amines, and trisazo pigments have high charge generating ability and are suitable for forming a highly-sensitive photosensitive layer.

The charge generating substances may be used each alone, or two or more of them may be used in combination. The content of the charge generating substance is not particularly limited, and preferably from 5 parts by weight to 500 parts by weight and more preferably from 10 parts by weight to 200 parts by weight based on 100 parts by weight of the binder resin in the charge generating layer. Also as the binder resin for charge generating layer, materials used customarily in the relevant field can be used including, for example, melamine resin, epoxy resin, silicone resin, polyurethane, acrylic resin, vinyl chloride-vinyl acetate copolymer resin, polycarbonate, phenoxy resin, polyvinyl butyral, polyallylate, polyamide, and polyester. The binder resins may be used each alone, or optionally two or more of them may be used in combination.

The charge generating layer can be formed by dissolving or dispersing an appropriate amount of a charge generating substance, a binder resin and, optionally, a plasticizer, a sensitizer and the like, respectively in an appropriate organic solvent which is capable of dissolving or dispersing the substances described above, to thereby prepare a coating solution for charge generating layer, and then applying the coating solution for charge generating layer to the surface of the conductive substrate, followed by drying. The thickness of the charge generating layer obtained in this way is not particularly limited, and preferably from 0.05 μm to 5 μm and more preferably from 0.1 μm to 2.5 μm.

The charge transporting layer stacked over the charge generating layer contains as essential substances a charge transporting substance having an ability of receiving and transporting charges generated from the charge generating substance, and binder resin for charge transporting layer, and optionally contains known antioxidant, plasticizer, sensitizer, lubricant and the like. As the charge transporting substance, materials used customarily in the relevant field can be used including, for example: electron donating substances such as poly-N-vinyl carbazole and a derivative thereof, poly-γ-carbazolyl ethyl glutamate and a derivative thereof, a pyrene-formaldehyde condensation product and a derivative thereof, polyvinylpyrene, polyvinyl phenanthrene, an oxazole derivative, an oxadiazole derivative, an imidazole derivative, 9-(p-diethylaminostyryl)anthracene, 1,1-bis(4-dibenzylaminophenyl)propane, styrylanthracene, styrylpyrazoline, a pyrazoline derivative, phenyl hydrazones, a hydrazone derivative, a triphenylamine compound, a tetraphenyldiamine compound, a triphenylmethane compound, a stilbene compound, and an azine compound having 3-methyl-2-benzothiazoline ring; and electron accepting substances such as a fluorenone derivative, a dibenzothiophene derivative, an indenothiophene derivative, a phenanthrenequinone derivative, an indenopyridine derivative, a thioquisantone derivative, a benzo[c]cinnoline derivative, a phenazine oxide derivative, tetracyanoethylene, tetracyanoquinodimethane, bromanil, chloranil, and benzoquinone.

The charge transporting substances may be used each alone, or two or more of them may be used in combination.

The content of the charge transporting substance is not particularly limited, and preferably from 10 parts by weight to 300 parts by weight and more preferably from 30 parts by weight to 150 parts by weight based on 100 parts by weight of the binder resin in the charge transporting layer. As the binder resin for charge transporting layer, it is possible to use materials which are used customarily in the relevant field and capable of uniformly dispersing the charge transporting substance, including, for example, polycarbonate, polyallylate, polyvinylbutyral, polyamide, polyester, polyketone, epoxy resin, polyurethane, polyvinylketone, polystyrene, polyacrylamide, phenolic resin, phenoxy resin, polysulfone resin, and copolymer resin thereof. Among those materials, in view of the film forming property, and the wear resistance, an electrical property etc. of the obtained charge transporting layer, it is preferable to use, for example, polycarbonate which contains bisphenol Z as the monomer ingredient (hereinafter referred to as "bisphenol Z polycarbonate"), and a mixture of bisphenol Z polycarbonate and other polycarbonate. The binder resin may be used each alone, or two or more of them may be used in combination.

The charge transporting layer preferably contains an antioxidant together with the charge transporting substance and the binder resin for charge transporting layer. For the antioxidant, substances used customarily in the relevant field can be used including, for example, vitamin E, hydroquinone, hindered amine, hindered phenol, paraphenylene diamine, arylalkane and derivatives thereof, an organic sulfur compound, and an organic phosphorus compound.

The antioxidants may be used each alone, or two or more of them may be used in combination. The content of the antioxidant is not particularly limited, and is 0.01% by weight to 10% by weight and preferably 0.05% by weight to 5% by weight of the total amount of the ingredients constituting the charge transporting layer. The charge transporting layer can be formed by dissolving or dispersing an appropriate amount of a charge transporting substance, binder resin and, optionally, an antioxidant, a plasticizer, a sensitizer and the like respectively in an appropriate organic solvent which is capable of dissolving or dispersing the ingredients described above, to thereby prepare a coating solution for charge transporting layer, and applying the coating solution for charge transporting layer to the surface of a charge generating layer followed by drying. The thickness of the charge transporting layer obtained in this way is not particularly limited, and preferably 10 μm to 50 μm and more preferably 15 μm to 40 μm. Note that it is also possible to form a photosensitive layer in which a charge generating substance and a charge transporting substance are present in one layer. In this case, the kind and content of the charge generating substance and the charge transporting substance, the kind of the binder resin, and other additives may be the same as those in the case of forming separately the charge generating layer and the charge transporting layer.

In the embodiment, there is used a photoreceptor drum which has an organic photosensitive layer as described above containing the charge generating substance and the charge transporting substance. It is, however, also possible to use, instead of the above photoreceptor drum, a photoreceptor drum which has an inorganic photosensitive layer containing silicon or the like.

The charging section 12 faces the photoreceptor drum 11 and is disposed away from the surface of the photoreceptor drum 11 longitudinally along the photoreceptor drum 11. The charging section 12 charges the surface of the photoreceptor drum 11 so that the surface of the photoreceptor drum 11 has predetermined polarity and potential. As the charging section 12, it is possible to use a charging brush type charging device, a charger type charging device, a pin array type charging device, an ion-generating device, etc. Although the charging section 12 is disposed away from the surface of the photoreceptor drum 11 in the embodiment, the configuration is not limited thereto. For example, a charging roller may be used as the charging section 12, and the charging roller may be disposed in pressure-contact with the photoreceptor drum. It is also possible to use a contact-charging type charger such as a charging brush or a magnetic brush.

The exposure unit 13 is disposed so that a light beam corresponding to each color information emitted from the exposure unit 13 passes between the charging section 12 and the developing device 14 and reaches the surface of the photoreceptor drum 11. In the exposure unit 13, the image information is converted into light beams corresponding to each color information of b, c, m, and y, and the surface of the photoreceptor drum 11 which has been evenly charged by the charging section 12, is exposed to the light beams corresponding to each color information to thereby form electrostatic latent images on the surfaces of the photoreceptor drums 11. As the exposure unit 13, it is possible to use a laser scanning unit having a laser-emitting portion and a plurality of reflecting mirrors. The other usable examples of the exposure unit 13 may include an LED (Light Emitting Diode) array or a unit in which a liquid-crystal shutter and a light source are appropriately combined, with each other.

Figure 6:
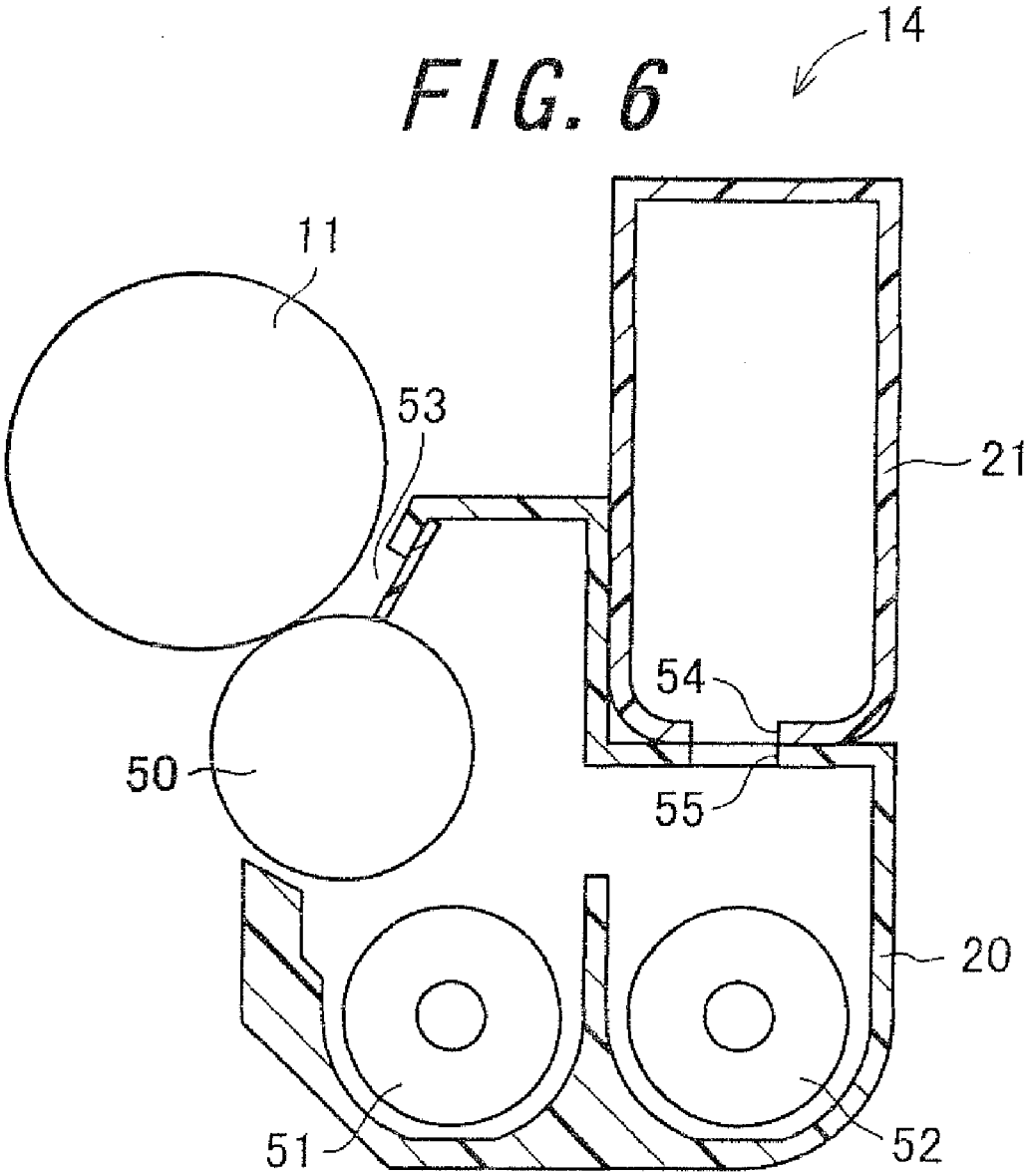
FIG. 6 is a schematic view schematically showing a cross section of a developing device.

FIG. 6 is a schematic view schematically showing a cross section of the developing device 14. The developing device 14 includes a developer tank 20 and a toner hopper 21. A developer used for the developing device 14 is the one-component developer or the two-component developer described above.

The developer tank 20 is a container-shaped member which is disposed so as to face the surface of the photoreceptor drum 11, supplies a toner to an electrostatic latent image formed on the surface of the photoreceptor drum 11 to be developed, and forms a toner image as a visualized image. The developer tank 20 contains in an internal space thereof the developer, and contains and supports roller members such as a developing roller 50, a supplying roller 51, and a stirring roller 52 or screw members so as to rotate freely. An opening 53 is formed in a side face of the developer tank 20 to face the photoreceptor drum 11, and on a position opposite to the photoreceptor drum 11 through the opening 53, a developing roller 50 is provided so as to be capable of rotationally driving.

The developing roller 50 is a roller-shaped member for supplying a toner to the electrostatic latent image on the surface of the photoreceptor 11 at a pressure-contact portion or most-adjacent portion between the developing roller 50 and the photoreceptor drum 11. In supplying the toner, to the surface of the developing roller 50, a potential whose polarity is opposite to a polarity of a charged potential of the toner is applied, which serves as a development bias voltage. By so doing, the toner on the surface of the developing roller 50 is smoothly supplied to the electrostatic latent image. Furthermore, an amount of the toner being supplied to the electrostatic latent image (a toner attachment amount) is able to be controlled by changing a value of the development bias voltage. The supply roller 51 is a roller-shaped member which is provided facing to the developing roller 50 so as to be capable of rotationally driving, and supplies the toner to the vicinity of the developing roller 50. The stirring roller 52 is a roller-shaped member which is provided facing the supplying roller 51 so as to be capable of rotationally driving, and feeds to the vicinity of the supplying roller 51 the toner, which is newly supplied from the toner hopper 21 into the developer tank 20.

The toner hopper 21 is disposed so as to communicate a toner replenishment port 54 formed in a vertically lower part of the toner hopper 21, with a toner reception port 55 formed in a vertically upper part of the developing tank 20. The toner hopper 21 replenishes the developing tank 20 with the toner according to toner consumption. Further, it may be possible to adopt such configuration that the developing tank 20 is replenished with the toner supplied directly from a toner cartridge of each color without using the toner hopper 21.

The cleaning unit 15 removes the toner which remains on the surface of the photoreceptor drum 11 after the toner image has been transferred to the recording medium, and thus cleans the surface of the photoreceptor drum 11. In the cleaning unit 15, a platy member is used such as a cleaning blade. Note that, in the image forming apparatus 100, an organic photoreceptor drum is mainly used as the photoreceptor drum 11. A surface of the organic photoreceptor drum contains a resin component as a main ingredient and therefore tends to be degraded by chemical action of ozone which is generated by corona discharging of the charging section 12. The degraded surface part is, however, worn away by abrasion through the cleaning unit 15 and thus removed reliably, though gradually. Accordingly, the problem of the surface degradation caused by the ozone, etc. is actually solved, and it is thus possible to stably maintain the potential of charges given by the charging operation over a long period of time. Although the cleaning unit 15 is provided in the embodiment, no limitation is imposed on the configuration and the cleaning unit 15 does not have to be provided.

In the toner image forming section 2, signal light corresponding to the image information is emitted from the exposure unit 13 to the surface of the photoreceptor drum 11 which has been evenly charged by the charging section 12, thereby forming an electrostatic latent image; the toner is then supplied from the developing device 14 to the electrostatic latent image, thereby forming a toner image; the toner image is transferred to an intermediate transfer belt 25 described below; and the toner which remains on the surface of the photoreceptor drum 11 is removed by the cleaning unit 15. A series of toner image forming operations just described are repeatedly carried out.

The transfer section 3 is disposed above the photoreceptor drum 11 and includes the intermediate transfer belt 25, a driving roller 26, a driven roller 27, an intermediate transferring roller 28*b*, 28*c*, 28*m*, 28*y*, a transfer belt cleaning unit 29, and a transferring roller 30. The intermediate transfer belt 25 is an endless belt supported around the driving roller 26 and the driven roller 27 with tension, thereby forming a loop-shaped travel path, and rotates in a direction of an arrow B.

When the intermediate transfer belt 25 passes by the photoreceptor drum 11 in contact therewith, the transfer bias voltage whose polarity is opposite to the charging polarity of the toner on the surface of the photoreceptor drum 11 is applied from the intermediate transferring roller 28 which is disposed opposite to the photoreceptor drum 11 through the intermediate transfer belt 25, and the toner image formed on the surface of the photoreceptor drum 11 is transferred onto the intermediate transfer belt 25. In the case of a full-color image, the toner images of respective colors formed by the respective photoreceptor drums 11 are sequentially transferred onto the intermediate transfer belt 25 and overlaid on top of one another, thus forming a full-color image. The driving roller 26 is provided so as to be capable of rotationally driving about an axis thereof by a driving section (not shown), and by the rotational driving, the intermediate transfer belt 25 is rotationally driven in the direction indicated by the arrow B.

The driven roller 27 can be driven to rotate by the rotation of the driving roller 26, and imparts constant tension to the intermediate transfer belt 25 so that the intermediate transfer belt 25 does not go slack.

The intermediate transferring roller 28 is disposed in pressure-contact with the photoreceptor drum 11 with the intermediate transfer belt 25 interposed therebetween, and capable of rotating around its own axis by a driving section (not shown). The intermediate transferring roller 28 is connected to a power source (not shown) for applying the transfer bias voltage as described above, and has a function of transferring the toner image formed on the surface of the photoreceptor drum 11 to the intermediate transfer belt 25.

The transfer belt cleaning unit 29 is disposed opposite to the driven roller 27 with the intermediate transfer belt 25 interposed therebetween so as to come into contact with an outer circumferential surface of the intermediate transfer belt 25. When the intermediate transfer belt 25 contacts the photoreceptor drum 11, the toner is attached to the intermediate transfer belt 25 and may cause contamination on a reverse side of the recording medium, and therefore the transfer belt cleaning unit 29 removes and collects the toner on the surface of the intermediate transfer belt 25.

The transferring roller 30 is disposed in pressure-contact with the driving roller 26 with the intermediate transfer belt 25 interposed therebetween, and capable of rotating around its own axis by a driving section (not shown). In a pressure-contact portion (a transfer nip region) between the transferring roller 30 and the driving roller 26, a toner image which has been borne by the intermediate transfer belt 25 and thereby conveyed to the pressure-contact portion is transferred onto a recording medium fed from the later-described recording medium feeding section 5. The recording medium bearing the toner image is fed to the fixing section 4.

In the transfer section 3, the toner image is transferred from the photoreceptor drum 11 onto the intermediate transfer belt 25 in the pressure-contact portion between the photoreceptor drum 11 and the intermediate transferring roller 28, and by the intermediate transfer belt 25 rotating in the arrow B direction, the transferred toner image is conveyed to the transfer nip region where the toner image is transferred onto the recording medium.

The fixing section 4 is provided downstream of the transfer section 3 along a conveyance direction of the recording medium, and contains a fixing roller 31 and a pressure roller 32.

The fixing roller 31 can rotate by a driving section (not shown), and heats and fuses the toner constituting an unfixed toner image borne on the recording medium. Inside the fixing roller 31 is provided a heating portion (not shown). The heating portion heats the fixing roller 31 so that a surface of the fixing roller 31 has a predetermined temperature (heating temperature). For the heating portion, a heater, a halogen lamp, and the like device can be used, for example. The heating portion is controlled by the fixing condition controlling processing. In the vicinity of the surface of the fixing roller 31 is provided a temperature detecting sensor which detects a surface temperature of the fixing roller 31. A result detected by the temperature detecting sensor is written to a memory portion of the later-described control unit.

The pressure roller 32 is disposed in pressure-contact with the fixing roller 31, and supported so as to be driven to rotate by the rotation of the fixing roller 31. The pressure roller 32 fixes the toner image onto the recording medium in cooperation with the fixing roller 31. At this time, the pressure roller 32 assists in the fixation of the toner image onto the recording medium by pressing the toner in a fused state due to heat from the fixing roller 31, against the recording medium. A pressure-contact portion between the fixing roller 31 and the pressure roller 32 is a fixing nip region.

In the fixing section 4, the recording medium onto which the toner image has been transferred in the transfer section 3 is hipped by the fixing roller 31 and the pressure roller 32 so that when the recording medium passes through the fixing nip region, the toner image is pressed and thereby fixed onto the recording medium under heat, whereby an image is formed.

The recording medium feeding section 5 includes an automatic paper feed tray 35, a pickup roller 36, conveying rollers 37, registration rollers 38, and a manual paper feed tray 39.

The automatic paper feed tray 35 is disposed in a vertically lower part of the image forming apparatus 100 and in form of a container-shaped member for storing the recording mediums. Examples of the recording medium include plain paper, color copy paper, sheets for overhead projector, and postcards.

The pickup roller 36 takes out sheet by sheet the recording mediums stored in the automatic paper feed tray 35, and feeds the recording mediums to a paper conveyance path A1. The conveying rollers 37 are a pair of roller members disposed in pressure-contact with each other, and convey the recording medium to the registration rollers 38. The registration rollers 38 are a pair of roller members disposed in pressure-contact with each other, and feed to the transfer nip region the recording medium fed from the conveying rollers 37 in synchronization with the conveyance of the toner image borne on the intermediate transfer belt 25 to the transfer nip region. The manual paper feed tray 39 is a member for taking recording mediums into the image forming apparatus 100, and recording mediums stored in the manual paper feed tray 39 are different from the recording mediums stored in the automatic paper feed tray 35 and may have any size. The recording medium taken in from the manual paper feed tray 39 passes through a paper conveyance path A2 by use of the conveying rollers 37, thereby being fed to the registration rollers 38.

In the recording medium feeding section 5, the recording medium supplied sheet by sheet from the automatic paper feed tray 35 or the manual paper feed tray 39 is fed to the transfer nip region in synchronization with the conveyance of the toner image borne on the intermediate transfer belt 25 to the transfer nip region.

The discharging section 6 includes the conveying rollers 37, discharging rollers 40, and a catch tray 41. The conveying rollers 37 are disposed downstream of the fixing nip region along the recording medium conveyance direction, and convey toward the discharging rollers 40 the recording medium onto which the image has been fixed by the fixing section 4. The discharging rollers 40 discharge the recording medium onto which the image has been fixed, to the catch tray 41 disposed on a vertically upper surface of the image forming apparatus 1. The catch tray 41 stores the recording medium onto which the image has been fixed.

The image forming apparatus 100 includes a control unit (not shown). The control unit is disposed, for example, in an upper part of an internal space of the image forming apparatus 100, and contains a memory portion, a computing portion, and a control portion. To the memory portion of the control unit are inputted, for example, various set values obtained by way of an operation panel (not shown) disposed on the vertically upper surface of the image forming apparatus 100, results detected from a sensor (not shown) etc. disposed in various portions inside the image forming apparatus 100, and image information obtained from an external equipment. Further, programs for executing various processings are written. Examples of the various processings include a recording medium determining processing, an attachment amount controlling processing, and a fixing condition controlling processing. For the memory portion, those customarily used in the relevant filed can be used including, for example, a read only memory (ROM), a random access memory (RAM), and a hard disk drive (HDD). For the external equipment, it is possible to use electrical and electronic devices which can form or obtain the image information and which can be electrically connected to the image forming apparatus 100. Examples of the external equipment include a computer, a digital camera, a television receiver, a video recorder, a DVD (Digital Versatile Disc) recorder, an HDDVD (High-Definition Digital Versatile Disc), a Elu-ray disc recorder, a facsimile machine, and a mobile computer. The computing portion of the control unit takes out the various data (such as an image formation order, the detected result, and the image information) written in the memory portion and the programs for various functional elements, and then makes various determinations. The control portion of the control unit sends to a relevant device a control signal in accordance with the result determined by the computing portion, thus performing control on operations. The control portion and the computing portion include a processing circuit which is achieved by a microcomputer, a microprocessor, etc. having a central processing unit. The control unit contains a main power source as well as the above-stated processing circuit. The power source supplies electricity to not only the control unit but also respective devices provided inside the image forming apparatus 100.

With the developing device 14 and the image forming apparatus 100, it is possible to form an image with high definition and high image quality without unevenness in the concentration for a long time.

Finally, the scope of the invention is indicated by the scope of claims rather than by the scope of embodiments described above. The above-described embodiments are to be considered in all respects as illustrative, the scope of the invention includes all other embodiments. That is, the invention includes a part of or all of the above-described embodiments and all embodiments changed within the scope of claims and within a range of equivalency of the scope of claims.

EXAMPLES

Hereinafter, examples of the method of manufacturing a toner of the invention will be shown.

<Definition of Each Value>

Hereinafter, "part" and "%" indicate "part by weight" and "% by weight" respectively, unless otherwise specified. The viscosity of the spray liquid, the glass transition point of the binder resin and the toner core particles, the softening point of the binder resin, the melting point of the release agent, the volume average particle size of the toner core particles, as well as the volume average particle size of the fine resin particles and the volume average particle size of the secondary aggregate in Examples and Comparative Examples are measured as follows.

[Glass Transition Point of Binder Resin and Toner Core Particle]

Using a differential scanning calorimeter (trade name: DSC220, manufactured by Seiko Instruments & Electronics Ltd.), 1 g of specimen was heated at a temperature increasing rate of 10° C./min to measure a DSC curve based on Japanese Industrial Standards (JIS) K7121-1987. A temperature at an intersection of a straight line that was elongated toward a low-temperature side from a base line on the high-temperature side of an endothermic peak corresponding to glass transition of the obtained DSC curve and a tangent line that was drawn so that a gradient thereof was maximum against a curve extending from a rising part to a top of the peak was obtained as the glass transition point ($T_g$).

[Softening Point of Binder Resin]

Using a flow characteristic evaluation apparatus (trade name: FLOW TESTER CFT-100C, manufactured by Shimadzu Corporation), 1 g of specimen was heated at a temperature increasing rate of 6° C./min, under load of 20 kgf/cm$^2$ ($19.6\times10^5$ Pa) so that the specimen was pushed out of a dye (nozzle opening diameter of 1 mm and length of 1 mm) and a temperature at the time when a half of the specimen had flowed out of the dye was obtained as the softening point ($T_m$).

[Melting Point of Release Agent]

Using the differential scanning calorimeter (trade name: DSC220, manufactured by Seiko Instruments & Electronics Ltd.), 1 g of specimen was heated from a temperature of 20 up to 200° C. at a temperature increasing rate of 10° C./min, and then an operation of rapidly cooling down from 200° C. to 20° C. was repeated twice, thus measuring a DSC curve. A temperature at a top of an endothermic peak corresponding to the melting on the DSC curve measured at the second operation, was obtained as the melting point of the release agent.

[Volume Average Particle Size of Toner Core Particles]

To 50 ml of electrolyte (trade name: ISOTON-II, manufactured by Beckman Coulter, Inc.), 20 mg of specimen and 1 ml of sodium alkylether sulfate ester were added, and a thus-obtained admixture was subjected to dispersion processing of an ultrasonic distributor (trade name: desktop two-frequency ultrasonic cleaner VS-D100, manufactured by AS ONE Corporation) for three minutes at an ultrasonic frequency of 20 kHz, thereby preparing a specimen for measurement. The measurement sample was analyzed by a particle size distribution-measuring device: MULTISIZER III (trade name) manufactured by Beckman Coulter, Inc. under the conditions that an aperture diameter was 20 μm and the number of particles for measurement was 50,000 counts. A volume particle size distribution of the sample particles was thus obtained from which the volume average particle size was then determined.

[Volume Average Particle Sizes of Fine Resin Particles and Secondary Aggregate]

Using the laser diffraction type particle size distribution measuring apparatus (trade name: Microtrac, manufactured by Nikkiso Co., Ltd.), a measurement was performed under the condition of transmission density to be measured: 0.01 to 0.1, and a volume average particle size was obtained by the volume particle size distribution of the specimen particles.

<Toner Manufacturing Apparatus>

For a toner manufacturing apparatus, an apparatus in which a liquid spraying unit is installed in Hybridization system (trade name: NHS-3 Model, manufactured by Nara Machinery Co., Ltd.) in accordance with the toner manufacturing apparatus 201 shown in FIG. 2 was used. As the liquid spraying unit, the one connected so as to quantitatively feed the volatile liquid (ethanol) to a two-fluid nozzle (trade name: HM-6 Model, manufactured by Fuso Seiki Co., Ltd.) through a liquid feeding pump (tradename: SP11-12, manufactured by FLOM Co., Ltd.) was used. The installation angle of the two-fluid nozzle was set so that an angle formed by the liquid spraying direction and the powder flowing direction is 0° (in parallel). In the gas discharging section 222, a gas detector (trade name: XP-3110, manufactured by New Cosmos Electric Co., Ltd.) was provided. The temperature regulation jacket was provided over the entire wall part of the powder passage 202. A temperature sensor was installed in the powder passage 202 and the temperature in the powder passage 202 was monitored. Additionally, an ammeter was installed in a driving motor and a current value I applied to the driving motor was monitored.

Examples 1 to 7 and Comparative Examples 1 to 15

Toners were respectively prepared by Examples 1 to 7 and Comparative Examples 1 to 15 as follows.

Example 1

[Preparation of Toner Core Particle]

| | |
|---|---|
| Polyester resin (trade name: DIACRON, manufactured by Mitsubishi Rayon Co., Ltd., glass transition point of 55° C., softening point of 130° C.) | 87.5% (100 parts) |
| C.I. Pigment Blue 15:3 | 5.0% (5.7 parts) |

-continued

| | |
|---|---|
| Release agent (Carunauba Wax, melting point of 82° C.) | 6.0% (6.9 parts) |
| Charge control agent (trade name: Bontron E84, manufactured by Orient Chemical Industries, Ltd.) | 1.5% (1.7 parts) |

After pre-mixing the materials of the toner core particles described above by a Henchel mixer (trade name: FM20C, manufactured by Mitsui Mining Co., Ltd.), the obtained mixture was melt-kneaded by a twinscrew extruder (trade name: PCM65 manufactured by Ikegai, Ltd.) After coarsely pulverizing the melt-kneaded material by a cutting mill (trade name: VM-16, manufactured by Orient Co., Ltd.), it was finely pulverized by a jet mill (manufactured by Hosokawa Micron Corporation) and then classified by a pneumatic classifier (manufactured by Hosokawa Micron Corporation) to produce toner core particles with a volume average particle size of 6.5 μm and a glass transition point of 56° C.

[Preparation of Fine Resin Particles]

Styrene and butyl acrylate were polymerized, and as slurry fine resin particles, a slurry solution of styrene butyl acrylate copolymer fine particles (glass transition point of 64° C. and softening point of 126° C.) with a volume average particle size of 0.1 μm was obtained.

This slurry was taken out by freeze-drying and fine dried particles are obtained. Further, the freeze-dried particles are pulverized by a rotary ball mill, and a measurement of the volume average particle size of the secondary aggregate of the fine resin particles was performed.

On measuring particle size distribution of the secondary aggregate of the fine resin particles, to 50 ml of pure water, 20 mg of specimen and 1 ml of sodium alkylether sulfate ester were added, and thus-obtained admixture was subjected to dispersion processing of an ultrasonic distributor (trade name: desktop two-frequency ultrasonic cleaner VS-D100, manufactured by AS ONE Corporation) for three minutes at an ultrasonic frequency of 20 kHz, thereby preparing a specimen for measurement.

The volume average particle size of the secondary aggregate of the fine resin particles was 4.8 μm.

[Stirring Step]

The temperature in the powder passage 202 was regulated to be 30° C., and the rotary stirring section 204 was rotated at idle at the rotation speed of 3200 rpm (peripheral speed of 80 m/sec in the outermost periphery). At this time, the current value $I_0$ applied to the driving motor of the rotary shaft section 218 was 28 A.

After that, while maintaining the temperature in the powder passage 202 and the rotation speed of the rotary stirring section, toner core particles of 400 g were inputted from the powder inputting section 206. After a lapse of a predetermined time from the completion of inputting of toner core particles, the current value $I_{core}$ applied to the driving motor of the stirring shaft 218 was stabilized after becoming 31 A.

After a lapse of a predetermined time from the completion of inputting of toner core particles while maintaining the temperature in the powder passage 202 and the rotation speed of the rotary stirring section, fine resin particles of 40 g was inputted. After three minutes from the completion of inputting of the fine resin particles, the current value I applied to the driving motor of the rotary shaft 218 was 45.1 A. From $F \propto I$, $F_0 \propto I_0$, $F_{core} \propto I_{core}$, the load coefficient $f=(F-F_0)/(F_{core}-F_0)=(I-I_0)/(I_{core}-I_0)$ was measured to be 5.70.

[Spraying Step]

After three minutes from the completion of inputting of the fine resin particles (load coefficient f=5.70) at the stirring step, spraying of ethanol is started. At this time, the rotary stirring section 204 was rotated at a rotation speed of 4000 rpm (peripheral speed of 100 m/sec in the outermost periphery). Furthermore, at this time, a supplying amount of carrier gas per unit time by the spraying section 203 was 5 L/min, and the supplying amount of carrier gas per unit time by the rotary shaft section 218 was 5 L/min, and the gas discharging amount per unit time by the gas discharging section 222 was 10 L/min. The density of the ethanol gas in the gas discharged from the gas discharging section 222 was 1.5 vol %.

After spraying ethanol for 30 minutes, spraying of ethanol was stopped, stirring was stopped after stirring for 10 minutes and a toner of Example 1 was obtained. In the spraying step, the temperature in the powder passage 202 was regulated to 30° C. as same as the stirring step.

Example 2

A toner of Example 2 was obtained in the same manner as Example 1 except for that the spraying step was started after 4 minutes from the completion of inputting of the fine resin particles (load coefficient f=4.13).

Example 3

A toner of Example 3 was obtained in the same manner as Example 1 except for that the spraying step was started after 5 minutes from the completion of inputting of the fine resin particles (load coefficient f=2.83).

Example 4

A toner of Example 4 was obtained in the same manner as Example 1 except for that the spraying step was started after 6 minutes from the completion of inputting of the fine resin particles (load coefficient f=1.73).

Example 5

A toner of Example 5 was obtained in the same manner as Example 1 except for that the fine resin particles in which a volume average particle size of the secondary aggregate was 3.7 μm were used and the spraying step was started after 2 minutes from the completion of inputting of the fine resin particles (load coefficient f=5.53).

Example 6

A toner of Example 6 was obtained in the same manner as Example 1 except for that the fine resin particles in which a volume average particle size of the secondary aggregate was 3.7 μm were used and the spraying step was started after 3 minutes from the completion of inputting of the fine resin particles (load coefficient f=3.47).

Example 7

A toner of Example 7 was obtained in the same manner as Example 1 except for that the fine resin particles in which a volume average particle size of the secondary aggregate was 3.7 μm were used and the spraying step was started after 4 minutes from the completion of inputting of the fine resin particles (load coefficient f=2.17).

Comparative Example 1

A toner of Comparative Example 1 was obtained in the same manner as Example 1 except for that the spraying step was started at the completion of inputting of the fine resin particles (load coefficient f=7.40).

Comparative Example 2

A toner of Comparative Example 2 was obtained in the same manner as Example 1 except for that the spraying step was started after 1 minute from the completion of inputting of the fine resin particles (load coefficient f=7.37).

Comparative Example 3

A toner of Comparative Example 3 was obtained in the same manner as Example 1 except for that the spraying step was started after 2 minutes from the completion of inputting of the fine resin particles (load coefficient f=6.93).

Comparative Example 4

A toner of Comparative Example 4 was obtained in the same manner as Example 1 except for that the spraying step was started after 7 minutes from the completion of inputting of the fine resin particles (load coefficient f=1.17).

Comparative Example 5

A toner of Comparative Example 5 was obtained in the same manner as Example 1 except for that the spraying step was started after 8 minutes from the completion of inputting of the fine resin particles (load coefficient f=1.03).

Comparative Example 6

A toner of Comparative Example 6 was obtained in the same manner as Example 1 except for that the spraying step was started after 9 minutes from the completion of inputting of the fine resin particles (load coefficient f=0.93).

Comparative Example 7

A toner of Comparative Example 7 was obtained in the same manner as Example 1 except for that the spraying step was started after 10 minutes from the completion of inputting of the fine resin particles (load coefficient f=0.90).

Comparative Example 8

A toner of Comparative Example 8 was obtained in the same manner as Example 1 except for that the fine resin particles in which a volume average particle size of the secondary aggregate was 3.7 μm were used and the spraying step was started at the completion of inputting of the fine resin particles (load coefficient f=7.37).

Comparative Example 9

A toner of Comparative Example 9 was obtained in the same manner as Example 1 except for that the fine resin particles in which a volume average particle size of the secondary aggregate was 3.7 μm were used and the spraying step was started after 1 minute from the completion of inputting of the fine resin particles (load coefficient f=7.10).

Comparative Example 10

A toner of Comparative Example 10 was obtained in the same manner as Example 1 except for that the fine resin particles in which a volume average particle size of the secondary aggregate was 3.7 μm were used and the spraying step was started after 5 minutes from the completion of inputting of the fine resin particles (load coefficient f=1.57).

Comparative Example 11

A toner of Comparative Example 11 was obtained in the same manner as Example 1 except for that the fine resin particles in which a volume average particle size of the secondary aggregate was 3.7 μm were used and the spraying step was started after 6 minutes from the completion of inputting of the fine resin particles (load coefficient f=1.27).

Comparative Example 12

A toner of Comparative Example 12 was obtained in the same manner as Example 1 except for that the fine resin particles in which a volume average particle size of the secondary aggregate was 3.7 μm were used and the spraying step was started after 7 minutes from the completion of inputting of the fine resin particles (load coefficient f=1.07).

Comparative Example 13

A toner of Comparative Example 13 was obtained in the same manner as Example 1 except for that the fine resin particles in which a volume average particle size of the secondary aggregate was 3.7 μm were used and the spraying step was started after 8 minutes from the completion of inputting of the fine resin particles (load coefficient f=1.00).

Comparative Example 14

A toner of Comparative Example 14 was obtained in the same manner as Example 1 except for that the fine resin particles in which a volume average particle size of the secondary aggregate was 3.7 μm were used and the spraying step was started after 9 minutes from the completion of inputting of the fine resin particles (load coefficient f=0.93).

Comparative Example 15

A toner of Comparative Example 15 was obtained in the same manner as Example 1 except for that the fine resin particles in which a volume average particle size of the secondary aggregate was 3.7 μm were used and the spraying step was started after 10 minutes from the completion of inputting of the fine resin particles (load coefficient f=0.87).

As to the toner manufacturing process of Examples 1 to 7 and Comparative Examples 1 to 15, spraying starting time, a current value I, a load increased amount $I-I_0$ and the load coefficient f are shown in left columns of Table 1 and left columns of Table 2, respectively. Table 1 shows the case of the toner manufacturing process using the fine resin particles in which a volume average particle size of the secondary aggregate is 4.8 μm (Examples 1 to 4, and Comparative Examples 1 to 7), and Table 2 shows the case of the toner manufacturing process using the fine resin particles in which a volume average particle size of the secondary aggregate is 3.7 μm (Examples 5 to 7, and Comparative Examples 8 to 15). For the spraying starting time, the fine resin particle inputting completion time was set to 0 minute.

Figure 7:
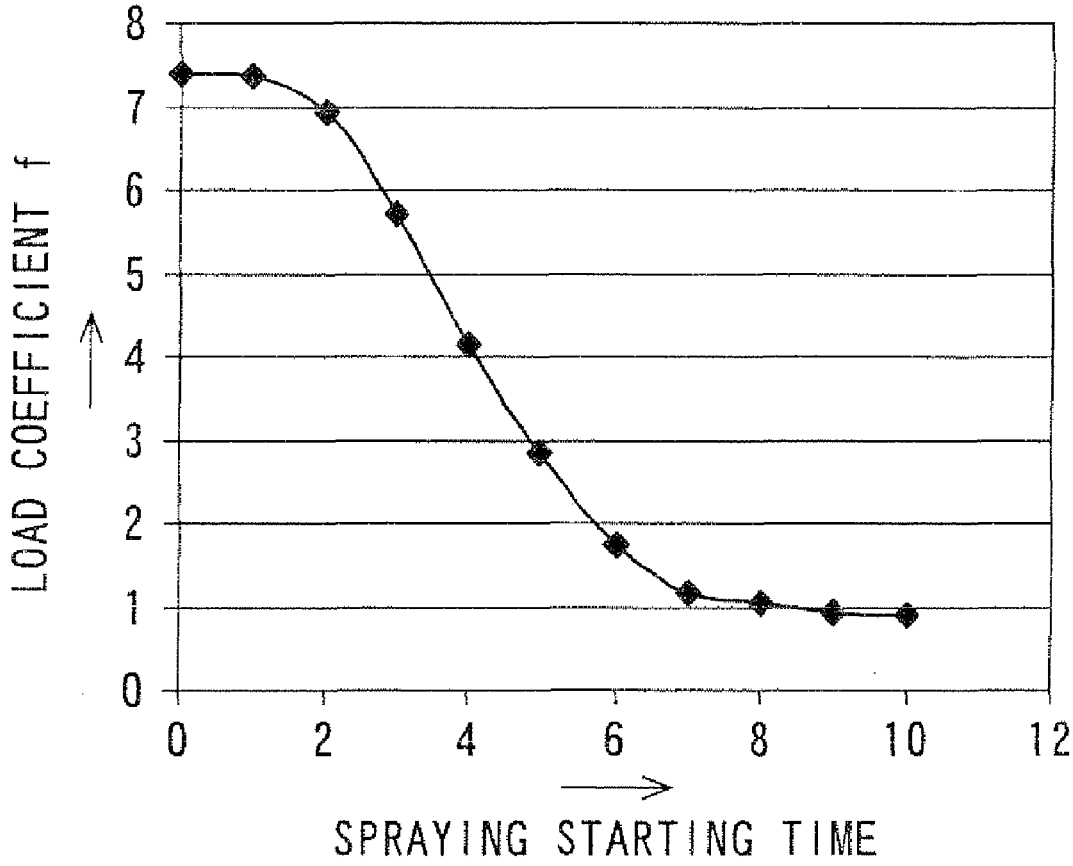
FIG. 7 is a graph showing a relation of the spraying starting time and the load coefficient f at the toner manufacturing process using fine resin particles in which a volume average particle size of the secondary aggregate is 4.8 μm.
Figure 8:
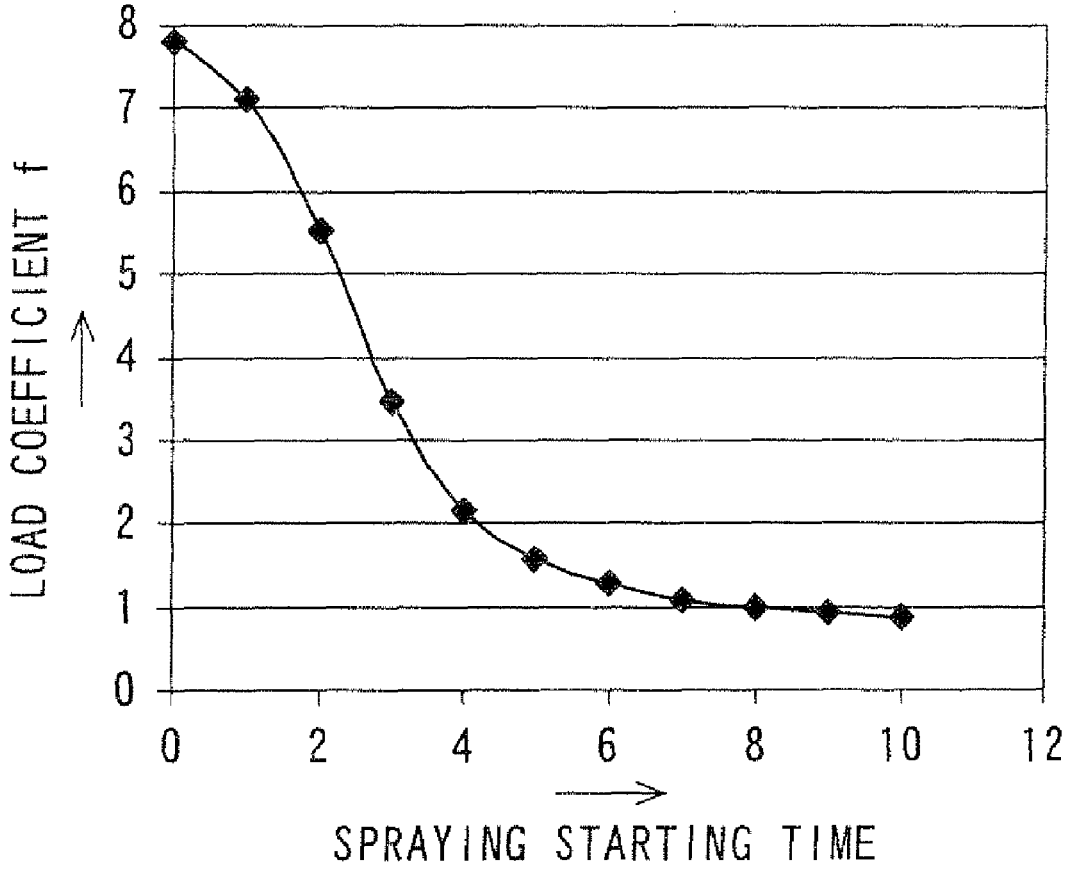
FIG. 8 is a graph showing a relation of the spraying starting time and the load coefficient f at the toner manufacturing process using the fine resin particles in which a volume average particle size of the secondary aggregate is 3.7 μm.

Additionally, FIG. 7 is a graph showing a relation of the spraying starting time and the load coefficient f at the toner manufacturing process using the fine resin particles in which a volume average particle size of the secondary aggregate is 4.8 μm. FIG. 8 is a graph showing a relation of the spraying starting time and the load coefficient f at the toner manufacturing process using the fine resin particles in which a volume average particle size of the secondary aggregate is 3.7 μm. In FIGS. 7 and 8, the load coefficient f is shown along the vertical axis, and the spraying starting time is shown along the horizontal axis.

TABLE 1

| | Spraying starting time | Current value I [A] | Load increased amount $I-I_0$ [A] | Load coefficient f | Preservation stability (Evaluation) |
|---|---|---|---|---|---|
| Comparative Example 1 | At completion of inputting fine resin particles (0 minute) | 50.2 | 22.2 | 7.40 | 5.8% (Poor) |
| Comparative Example 2 | after 1 minute | 50.1 | 22.1 | 7.37 | 4.5% (Poor) |
| Comparative Example 3 | after 2 minutes | 48.8 | 20.8 | 6.93 | 2.3% (Poor) |
| Example 1 | after 3 minutes | 45.1 | 17.1 | 5.70 | 0.8% (Good) |
| Example 2 | after 4 minutes | 40.4 | 12.4 | 4.13 | 0.1% (Excellent) |
| Example 3 | after 5 minutes | 36.5 | 8.5 | 2.83 | 0.1% (Excellent) |
| Example 4 | after 6 minutes | 33.2 | 5.2 | 1.73 | 1.1% (Good) |
| Comparative Example 4 | after 7 minutes | 31.5 | 3.5 | 1.17 | 2.8% (Poor) |
| Comparative Example 5 | after 8 minutes | 31.1 | 3.1 | 1.03 | 3.2% (Poor) |
| Comparative Example 6 | after 9 minutes | 30.8 | 2.8 | 0.93 | 4.1% (Poor) |
| Comparative Example 7 | after 10 minutes | 30.7 | 2.7 | 0.90 | 5.9% (Poor) |

TABLE 2

| | Spraying starting time | Current value I [A] | Load increased amount $I-I_0$ [A] | Load coefficient f | Preservation stability (Evaluation) |
|---|---|---|---|---|---|
| Comparative Example 8 | At completion of inputting fine resin particles (0 minute) | 51.5 | 23.5 | 7.83 | 5.8% (Poor) |
| Comparative Example 9 | after 1 minute | 49.3 | 21.3 | 7.10 | 3.2% (Poor) |
| Example 5 | after 2 minutes | 44.6 | 16.6 | 5.53 | 0.7% (Good) |
| Example 6 | after 3 minutes | 38.4 | 10.4 | 3.47 | 0.1% (Excellent) |
| Example 7 | after 4 minutes | 34.5 | 6.5 | 2.17 | 0.5% (Excellent) |
| Comparative Example 10 | after 5 minutes | 32.7 | 4.7 | 1.57 | 2.5% (Poor) |
| Comparative Example 11 | after 6 minutes | 31.8 | 3.8 | 1.27 | 3.5% (Poor) |
| Comparative Example 12 | after 7 minutes | 31.2 | 3.2 | 1.07 | 4.1% (Poor) |
| Comparative Example 13 | after 8 minutes | 31 | 3 | 1.00 | 4.6% (Poor) |
| Comparative Example 14 | after 9 minutes | 30.8 | 2.8 | 0.93 | 5.3% (Poor) |
| Comparative Example 15 | after 10 minutes | 30.6 | 2.6 | 0.87 | 5.9% (Poor) |

<Evaluation>

Evaluations were performed as follows as to the toner obtained by Examples 1 to 7 and Comparative Examples 1 to 15, respectively. As to each of the toners, evaluation results are shown in the right column of Table 1 and in the right column of Table 2.

<Preservation Stability>

After 20 g of toners were sealed in a plastic container and have been left for forty-eight hours at 50° C., the toners were taken out and passed through a 230-mesh sieve. The weight of the toners remaining on the sieve was measured and a remaining rate as a rate of this weight to the total weight of the toner was obtained. The lower numerical value of the remaining rate shows that the preservation stability of the toner is excellent and the toner is hard to block. That is, the lower numerical value of the remaining rate shows that the uniformity of the resin layer is excellent and the toner is hard to cause the wax bleed.

Evaluation standards for the preservation stability are as follows:

Excellent: No aggregation. 0 [%]≦remaining rate≦0.5 [%]

Good: Trace aggregations. 0.5 [%]≦remaining rate≦1.5 [%]

Not bad: Few aggregations. 1.5 [%]≦remaining rate≦2.0 [%]

Poor: Many aggregation. 2.0 [%]≦remaining rate≦

<Consideration>

From Examples 1 to 7 and Comparative examples 1 to 15, it is understood that when the spraying step is started within a period satisfying 1.7≦load coefficient f≦5.7, toners excellent in preservation stability are able to be obtained irrespective of the volume average particle size of the secondary aggregate of the fine resin particles. That is, toners in which uniformity of the thickness of the resin layer is increased and the wax bleed is suppressed are able to be obtained. Furthermore, as the wax bleed is being suppressed, the fluidity of the toner is increased.

Accordingly, it is understood that when the spraying step is started within a period satisfying 1.7≦load coefficient f≦5.7, a toner whose characteristics such as fluidity and preservation stability are excellent, and in which a resin layer whose thickness is uniform is formed on the surface of the toner core particle is formed is able to be manufactured, irrespective of the volume average particle size of the secondary aggregate of the fine resin particles.

On the other hand, it is understood that without considering the load coefficient f, when the spraying step is started at a constant time all the time even though the volume average particle size of the secondary aggregate of the fine resin particles is varied, toners whose characteristics are deteriorated are manufactured in some cases. For example, in a case where the volume average particle size of the secondary aggregate is 4.8 μm, when the spraying step is started after 5 minutes from the completion of inputting of the fine resin particles, a toner whose characteristics are very excellent (Example 3) is obtained, however, in a case where the volume average particle size of the secondary aggregate is 3.7 μm, when the spraying step is started after 5 minutes from the completion of inputting of the fine resin particles, a toner whose characteristics are deteriorated (Comparative Example 10) is obtained.

Moreover, from Examples 2, 3, 6, and 7, it is understood that when the spraying, step is started within a period satisfying 2.15≦load coefficient f≦4.15, a toner whose characteristics such as fluidity and preservation stability are excellent and in which a resin layer whose thickness is uniform is formed on the surface of the toner core particle is formed is able to be manufactured, irrespective of the volume average particle size of the secondary aggregate of the fine resin particles.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A toner manufacturing method of manufacturing a toner using a toner manufacturing apparatus comprising a powder passage in which powder is flowable, a carrier gas supplying section that supplies a carrier gas to the powder passage, a spraying section that sprays a predetermined substance with the carrier gas to the powder passage, a rotary stirring section disposed in the powder passage for stirring particles in the powder passage to fluidize the particles in the powder passage, and an discharging section that discharges a gas from the powder passage, comprising:

a stirring step of rotating the rotary stirring section at a predetermined rotation speed and fluidizing toner core particles and fine resin particles in the power passage as the powder; and a spraying step of spraying with the carrier gas a liquid that plasticizes the fine resin particles as the predetermined substance by the spraying section, during rotation of the rotary stirring section, after a completion of inputting the fine resin particles into the powder passage, and within a period satisfying the following formula (1), the spraying step is started:

$$1.7 \leqq (F-F_0)/(F_{core}-F_0) \leqq 5.7 \quad (1)$$

where $F_0$ is a load applied to the rotary stirring section when the rotary stirring section is rotated at idle at the predetermined rotation speed, $F_{core}$ is a load applied to the rotary stirring section when the rotary stirring section is rotated at the predetermined rotation speed, and only the toner core particles are fluidized in the powder passage as the powder, and F is a load applied to the rotary stirring section in the stirring step.

2. The toner manufacturing method of claim 1, wherein during rotation of the rotary stirring section, after a completion of inputting the fine resin particles into the powder passage, and within a period satisfying the following formula (2), the spraying step is started:

$$2.15 \leqq (F-F_0)/(F_{core}-F_0) \leqq 4.15 \quad (2).$$

3. The toner manufacturing method of claim 1, wherein the rotary stirring section is an element that includes a driving motor and rotates and stirs by applying current to the driving motor, and the load applied to the rotary stirring section is obtained by measuring a current value of the current applied to the rotary stirring section.

4. A toner obtained by the toner manufacturing method of claim 1.

5. A one-component developer comprising the toner of claim 4.

6. A developing device that performs development by using the one-component developer of claim 5.

7. An image forming apparatus comprising the developing device of claim 6.

8. A two-component developer comprising the toner of claim 4 and a carrier.

9. A developing device that performs development by using the two-component developer of claim 8.

10. An image forming apparatus comprising the developing device of claim 9.

* * * * *